US012571389B2

(12) United States Patent
Bredbeck et al.

(10) Patent No.: US 12,571,389 B2
(45) Date of Patent: Mar. 10, 2026

(54) PISTON, COMPRESSOR, COMPRESSED-AIR SUPPLY SYSTEM, VEHICLE, AND METHOD FOR OPERATING A COMPRESSED-AIR SUPPLY SYSTEM

(71) Applicant: ZF CV Systems Europe BV, Brussels (BE)

(72) Inventors: Klaus Bredbeck, Landesbergen (DE); Elmar Schillon, Algermissen (DE); Uwe Stabenow, Laatzen (DE)

(73) Assignee: ZF CV Systems Europe BV, Brussels (BE)

( * ) Notice: Subject to any disclaimer, the term of this patent is extended or adjusted under 35 U.S.C. 154(b) by 91 days.

(21) Appl. No.: 18/492,364

(22) Filed: Oct. 23, 2023

(65) Prior Publication Data

US 2024/0060487 A1 Feb. 22, 2024

Related U.S. Application Data

(63) Continuation of application No. PCT/EP2022/059438, filed on Apr. 8, 2022.

(30) Foreign Application Priority Data

Apr. 22, 2021 (DE) ..... 10 2021 110 256.1

(51) Int. Cl.
*F04B 53/14* (2006.01)
*F04B 19/22* (2006.01)

(52) U.S. Cl.
CPC ..... *F04B 53/143* (2013.01); *F04B 19/22* (2013.01); *F04B 53/14* (2013.01)

(58) Field of Classification Search
CPC ..... F04B 53/143; F04B 19/22; F04B 53/14; F04B 25/00; F04B 25/02; F04B 39/0016;
(Continued)

(56) References Cited

U.S. PATENT DOCUMENTS 1,866,022 A * 7/1932 Findeisen ..... F02B 75/28 123/53.1
2,600,516 A * 6/1952 Pielop, Jr. ..... F04B 53/144 92/244

(Continued)

FOREIGN PATENT DOCUMENTS

DE 11 03 540 B 3/1961
DE 10 2008 031 848 A1 1/2010

(Continued)

OTHER PUBLICATIONS

International Search Report of the European Patent Office dated Jun. 9, 2022 for international application PCT/EP2022/059438 on which this application is based.

(Continued)

*Primary Examiner* — Benjamin Doyle
(74) *Attorney, Agent, or Firm* — Walter Ottesen, P.A.

(57) ABSTRACT

A piston for a compressor has a first end subjectable to pressure and intended to be directed toward a first volume of the compressor, and a second end subjectable to pressure located opposite the first and intended to be directed toward a second volume of the compressor. The first and the second volume are interconnected via a connecting line. The first end is in the form of a full-surface-area full side. The second end is in the form of an annular, stepped side. On the second end, the piston carries a sealing arrangement, which seals the first volume with respect to the second. An annular seal body, in the form of a sealing sleeve, is retained in a pressure-tight manner, via a profile base, on the stepped side, between a step-side piston ring arranged on the second end and a compression-volume-side retaining ring.

34 Claims, 12 Drawing Sheets

(58) Field of Classification Search
CPC .. F04B 39/0005; F04B 53/164; F04B 19/003; F16J 15/3236; F16J 15/56; F16J 15/3212; F16J 15/3232; F16J 15/3268; F16J 15/061; F16J 15/164; F16J 15/3216
USPC ..... 417/521; 277/551, 521, 311; 92/172–260
See application file for complete search history.

(56) References Cited

U.S. PATENT DOCUMENTS 2,637,606 A * 5/1953 Pielop, Jr. ..... F16J 15/3216 92/241
2,701,155 A * 2/1955 Estel, Jr. ..... F16J 15/3236 267/165
2,780,208 A * 2/1957 Brown ..... F02B 75/002 123/61 R
2,927,830 A * 3/1960 Workman ..... F16J 15/3236 92/194
3,340,855 A * 9/1967 Brown ..... F02B 33/14 123/41.35
3,645,542 A * 2/1972 Adams ..... F16J 15/3236 277/500
3,694,111 A * 9/1972 Braun ..... F01B 11/003 417/535
3,718,338 A * 2/1973 Traub ..... F16J 15/56 277/584
4,023,467 A * 5/1977 Thurner ..... F16J 1/006 92/194
4,706,970 A * 11/1987 Ramirez ..... F16J 15/3212 277/556
5,113,808 A * 5/1992 Eickmann ..... F02B 75/20 123/55.2
5,513,674 A * 5/1996 Frisch ..... F16J 15/56 251/324
6,547,250 B1 * 4/2003 Noble ..... F16J 15/164 277/471
8,449,201 B2 * 5/2013 Russ ..... F16C 33/7896 384/607
2007/0013143 A1 * 1/2007 Schroeder ..... F16J 15/3236 277/551
2007/0017763 A1 1/2007 Lin
2007/0222157 A1 * 9/2007 Kondo ..... F04B 53/143 277/345
2010/0052267 A1 * 3/2010 Castleman ..... F16J 15/166 277/553
2010/0059937 A1 * 3/2010 Castleman ..... F16J 15/56 277/309
2014/0332536 A1 * 11/2014 Grant ..... B65B 7/2878 277/637
2015/0209986 A1 7/2015 Sommer et al.
2019/0315329 A1 * 10/2019 Adamski ..... B60T 15/181
2020/0025189 A1 1/2020 Bredbeck et al.
2020/0102947 A1 * 4/2020 Wichern ..... F04B 25/00
2021/0246985 A1 * 8/2021 Okladek ..... F16J 15/3236

FOREIGN PATENT DOCUMENTS

DE 10 2010 054 710 A1 6/2012
DE 10 2011 121 750 A1 6/2013
DE 10 2012 019 618 A1 4/2014
DE 10 2013 221 845 A1 5/2014
DE 10 2012 223 114 A1 6/2014
DE 10 2013 101 110 A1 8/2014
GB 241 907 A 4/1926
WO 2018/197182 A1 11/2018

OTHER PUBLICATIONS

English translation and Written Opinion of the International Searching Authority dated Jun. 9, 2022 for international application PCT/EP2022/059438 on which this application is based.

* cited by examiner

PISTON, COMPRESSOR, COMPRESSED-AIR SUPPLY SYSTEM, VEHICLE, AND METHOD FOR OPERATING A COMPRESSED-AIR SUPPLY SYSTEM

CROSS-REFERENCE TO RELATED APPLICATIONS

This application is a continuation application of international patent application PCT/EP2022/0059438, filed Apr. 8, 2022, designating the United States and claiming priority from German application 10 2021 110 256.1, filed Apr. 22, 2021, and the entire content of both applications is incorporated herein by reference.

TECHNICAL FIELD

The disclosure relates to a piston and to a compressor, in particular an air compressor. The disclosure also relates to a compressed-air supply system, a vehicle and a method for operating a compressed-air supply system.

BACKGROUND

Compressors, in particular piston compressors in vehicles of all kinds, are widely known. They are used to provide compressed air and cover many areas of application, including brake systems, air spring systems, in particular for level control, clutch boosters and many more. Among the important target criteria in the configuration of compressors are the highest possible delivery rate, the lowest possible noise generation, the smallest possible dimensions, a low outlay on production and a high degree of robustness.

US 2015/0209986 discloses a production method for a piston having a circumferential seal in the form of a circular cup seal, in particular for use in a reciprocating piston compressor.

DE 10 2011 121 750 A1 discloses, for example, a compressor, having a piston, the piston head of which is rigidly connected to a connecting rod, wherein a connecting rod bearing eye of the connecting rod is rotatably supported on an eccentric pin of a drive shaft of a drive motor.

Nevertheless, the approach including the rigid connection between the connecting rod and the piston leads to leaks between the piston and the cylinder due to the wobbling movement inherent in the configuration, leaks which are supposed to be counteracted by appropriate configuration measures, for example, seals.

DE 10 2013 101 110 A1 discloses a reciprocating piston compressor having a piston which is driven by a slider-crank mechanism and can be moved back and forth in a cylinder and is sealed with respect to the cylinder wall, which piston is arranged in a fixed manner with respect to the connecting rod axis, wherein the piston and/or the cylinder are configured in such a way that the crescent-shaped gaps between the piston edge and the cylinder wall which arise during the compression stroke as a result of the relative inclination or tilting between the piston and the cylinder can be sealed, thereby compensating for leaks.

The concept of a two-stage compressor in which the air fed in is first compressed to a low-pressure level in a low-pressure stage and then to a high-pressure level in a high-pressure stage connected to the low-pressure stage has proven successful.

To increase compactness, a two-stage compressor can be embodied in such a way that both compressor stages are formed by just one piston, for example via a piston which can be acted upon from two sides.

GB 241,907, for example, discloses a multi-stage compressor which can implement an arbitrary number of compressor stages via a piston having an arbitrary number of stage sections and a cylinder of matching configuration.

DE 10 2010 054 710 A1 furthermore discloses a compressor for a compressed-air feed of a compressed-air supply system, which compressor has at least one two-stage compressor unit having a single cylinder with a single piston that can be acted upon from two sides in a compression volume of the cylinder.

DE 10 2012 223 114 A1 furthermore describes a double piston compressor unit. A drive shaft of the motor of the compressor unit cooperates with the unit via a slotted-link guide in the double piston of the unit in such a way that the double piston alternately carries out a compression process in the two cylinders of the unit. In this case, the axis of the drive shaft is arranged eccentrically with respect to the central axis of the two cylinders, resulting in fewer changes in the position of the piston and thus less noise generation.

The concept is still in need of improvement with regard to the abovementioned disadvantages and target criteria. It is therefore desirable to implement the function of a high-performance, in particular two-stage, compressor in a configuration that is as compact and robust as possible.

The compressor 100 of WO 2018/197182 A2 (corresponding to US 2020/0102947), already described here in this application with reference to FIG. 1 and FIG. 2A, FIG. 2B, for a compressed-air feed 10 of a compressed-air supply system 200, for operating a pneumatic system 500, has a piston of the type mentioned at the outset.

The compressor 100 of WO 2018/197182 A2 has:

- a first compression volume 104, a second compression volume 106, an air feed connection 120 and a compressed-air outlet 124,
- a piston 1112 having a first end side 113, which can be subjected to pressure and which is directed toward the first compression volume 104, and a second end side 115, which can be subjected to pressure, is located opposite the first end side 113 and is directed toward the second compression volume 106, wherein the first compression volume 104 is delimited by the first end side 113 and the second compression volume 106 is delimited by the second end side 115 of the piston 1112, wherein the first end side 113 is a full side 114 and the second end side 115 is a stepped side 116, and the piston 1112 is connected to a drive 102 via a connecting rod 128, wherein
- the first compression volume 104 and the second compression volume 106 are connected to one another via a connecting line 122. In the compressor 100 of WO 2018/197182 A2, it is envisaged that
- the connecting rod 128 is connected rigidly, in particular rigidly and in a manner free of joints, to the piston 1112 on a piston side 128.1 and is connected to a rotating part 131 of the drive 102 in a rotatable manner on a drive side 128.2, and
- the piston 1112 carries, on the stepped side 116, at least one seal 138, which seals the first compression volume 104 and/or the second compression volume 106.

The seal 138 on the piston 1112 already described in this application with reference to FIG. 3A, FIG. 3B is still in need of improvement with regard to the abovementioned disadvantages and target criteria.

SUMMARY

It is an object of the disclosure to provide an improved device, in particular a piston and a compressor, as well as a method which at least partially meets the objectives and target criteria formulated above, in particular via an improved structural configuration. In particular, it is an object of the disclosure to configure the device and the method in such a way that, in the context of the improved structural configuration, on the one hand an improved sealing effect and, on the other hand, improved retention of the seal are achieved, the seal furthermore being held in a pressure-tight manner on the stepped side, thus ensuring that the first compression volume and the second compression volume are sealed, even under long-term and high stress, in the context of the wobbling movement of a piston.

The object with respect to the device is, for example, achieved via a piston according to the disclosure.

A piston according to the disclosure starts from a piston for a compressor. Such a compressor has proven successful, in particular, for a compressed-air feed of a compressed-air supply system, for operating a pneumatic system, wherein the piston is configured to be movably guided in a cylinder of the compressor during operation of the compressor and can be attached to a drive via a connecting rod, wherein the connecting rod can be connected to the piston on a piston side and can be connected to a rotating part of the drive in a rotatable manner on a drive side.

According to the disclosure, such a piston has:

a first end side, which can be subjected to pressure and is intended to be directed, during operation, toward a first compression volume of the compressor, and a second end side, which can be subjected to pressure, is located opposite the first end side and is intended to be directed, during operation, toward a second compression volume of the compressor. In particular, the first compression volume can advantageously be delimited by the first end side and the second compression volume by the second end side of the piston.

In the case of such a piston, the disclosure furthermore envisages that the first compression volume and the second compression volume are connected to one another via a connecting line, which can be subjected to pressure.

In order to achieve the object, it is furthermore envisaged according to the disclosure that the annular seal body, in the form of a sealing sleeve of the sealing arrangement, is retained in a pressure-tight manner, by way of its profile base, on the stepped side, between a step-side piston ring arranged on the second end side and a compression-volume-side retaining ring.

The object relating to the device is, for example, also achieved by a compressor that uses the piston according to the disclosure, namely a compressor, in particular an air compressor, for a compressed-air feed of a compressed-air supply system, for operating a pneumatic system, having a first compression volume, a second compression volume, an air feed connection and a compressed-air outlet, and the piston.

According to the disclosure, the compressor is provided with:

a cylinder having a first compression volume and a second compression volume, an air feed connection and a compressed-air outlet, and the piston according to the disclosure.

The disclosure proceeds from the consideration that the basic approach of a piston as described in the context of the compressor of WO 2018/197182 A2 with an already advantageous seal basically provides the correct approach for the implementation of a compressor advantageously provided with a first and second compression volume. That is, that the approach is to provide a seal that seals the first compression volume with respect to the second compression volume, wherein the piston has a first end side in the form of a full side and a second end side in the form of a stepped side.

The seal is advantageously configured to seal the second compression volume with respect to a crankcase interior and/or with respect to the environment and/or to seal the first compression volume with respect to the second compression volume. The at least one seal advantageously produces a radially acting pressure-tight seal on the stepped side of the piston, both on an outer side and on an inner side, and, in particular, is advantageously formed via a single seal body.

A full side, as described by way of example in WO 2018/197182 A2 (full side 114), should be understood as a planar configuration of a first end side of the piston extending substantially continuously over the cylinder cross section.

As in WO 2018/197182 A2 (stepped side 116), a stepped side should accordingly be understood as a substantially annular configuration of the present second end side, that is, which therefore does not form the piston in such a way that it can be subjected to pressure over the entire cylinder cross section on the second end side but instead provides only an annular space which can be subjected to pressure, in particular an annular space in the peripheral area of the second end side.

In the present case, the content of WO 2018/197182 A2 and its disclosure are fully incorporated into the present application by citation and are therefore also available as the content of the disclosure in this application. By way of example, reference is made for purposes of illustration to the embodiments in relation to FIG. 1, FIG. 2 and FIG. 5 of WO 2018/197182 A2, which are shown in this application as FIG. 1, FIGS. 2A and 2B and FIGS. 3A and 3B.

In the context of one embodiment, this shows, by way of example, purely for purposes of illustration and in a manner that is not restrictive here, that—in accordance with the concept of the disclosure—the first end side is formed as a full side—which in that case is formed substantially in the manner of a dome—while the second end side is formed as an annular surface, which is in that case arranged substantially in an annular manner at the outer circumference to form a stepped side.

Other embodiments are possible; for example, the stepped side could also be only partially annular or form an inner annular space. The stepped side could also form a full inner space, which is therefore not limited only to a peripheral annular surface which can be subjected to pressure, as explained in the embodiments of the present application. Thus, a stepped side can relate to any relatively small stepped formation of a pressurizable surface on the second end side of the piston which is smaller than a full side of the first end side of the piston. Realistically, however, it is the substantially circular full side and the annular stepped side that have proven to be pressurizable and sealable with an annular seal, and this is thus at the forefront of the concept in the present case, as shown in this application in FIG. 1, FIGS. 2A and 2B and as well as FIG. 4A to FIG. 8 in the context of the preferred embodiments.

Following these above-stated basic considerations regarding the piston shape and the seal, the seal is already advantageously formed as such via a profiled annular seal body having a circumferentially extending first annular lip on an outer side of the seal and a circumferentially extending second annular lip on an inner side of the seal. The seal body thus advantageously has a first and a second annular sealing lip on the outer and inner sides, respectively, for sealing the annular peripheral annular space on the stepped side of the piston on the outer side, on the one hand, and on the inner side, on the other hand, that is, for sealing the second compression volume with respect to the first compression volume.

Proceeding from this consideration, the disclosure has also recognized that, in order to achieve the object, it is advantageous in an improved way for the annular seal body to be formed as a sealing sleeve with a profile which is open in circumferential cross section, which has a profile base, and the profile wall of which is formed via the first annular lip and the second annular lip. It is therefore advantageous, in turn, if the profile wall of the profile is formed via the first annular lip and the second annular lip; however, the profile according to the disclosure is open in circumferential cross section and thus has an exposed profile base. In contrast to the previously known forms of the aforementioned prior art, the disclosure has recognized here that the circumferential cross section of the profile should be fundamentally open. The prior art, on the other hand, follows the approach that the circumferential cross section should also be provided with a sealing profile filling. The present disclosure follows a different insight; namely, an exposed profile base makes it possible not only to achieve the object in terms of good sealing but also to use the open profile for advantageous retention of the sealing sleeve.

According to the disclosure, in contrast to the prior art, it is thus further envisaged that the sealing sleeve is retained in a pressure-tight manner, by way of its profile base, on the stepped side, between a step-side piston ring arranged on the second end side and a compression-volume-side retaining ring.

This feature uses the, to this extent, exposed profile base of the open profile to retain the sealing sleeve at its profile base between a step-side piston ring and a compression-volume-side retaining ring.

The retention of the sealing sleeve by way of its profile base between the step-side piston ring arranged on the second end side and the compression-volume-side retaining ring is furthermore configured to be pressure-tight and thus provides a pressure-tight configuration of the overall sealing arrangement including the sealing sleeve, the piston ring and the retaining ring; in other words, like a previously known solid-profile seal body but now with improved structure and stability and retention of the overall sealing arrangement. This significantly boosts the durability and pressure tightness of the sealing arrangement.

The retention of the sealing sleeve at its profile base between the step-side piston ring on the one hand and the compression-volume-side retaining ring on the other hand thus results in secure structural retention and also pressure-tight retention, which avoids a pressure loss along the contact surface between the profile base, the piston ring and the retaining ring and, on the other hand, also supports the sealing effect of the sealing lips through the shaping of the profile base.

In order to achieve the object as it relates to the device, the disclosure furthermore also leads to a compressed-air supply system and a vehicle having the compressed-air supply system.

A compressed-air supply system according to the disclosure is configured for operating a pneumatic system having a compressor and has:

an air feed and the compressor connected thereto via an air feed connection, a pneumatic main line, which is pneumatically connected to the compressor via a compressed-air outlet and has an air dryer, leading to a compressed-air connection of a gallery, a pressure medium reservoir, which is pneumatically connected to the compressor via a charging connection.

The object as it relates to the method is also achieved by a method that uses the piston according to the disclosure. A method for operating a compressed-air supply system includes the following steps:

compressing air from a crankcase interior and/or the environment in a first compression volume of the compressor to a low pressure level, further compressing the compressed air compressed to a low pressure level in the first compression volume to a high pressure level in a second compression volume of the compressor, feeding the compressed air compressed to a high pressure level in the second compression volume from the compressed-air outlet via a pneumatic main line to a compressed-air connection of a gallery, in particular via an air dryer.

Even if the embodiments described here provide for series connection of a first compression volume and a second compression volume—generally in the form of a series connection of two compressor stages of what is thus a multi-stage compressor—it should nevertheless be understood that the concepts of the disclosure are not limited thereto. Alternatively, in another embodiment, the concepts of the disclosure can also be implemented in a multi-stage compressor whose two or more compressor stages are implemented in the form of a parallel connection-generally, therefore, in the form of a parallel connection of two compressor stages of what is thus a multi-cylinder compressor.

It is advantageous to provide for the first end side to be in the form of a full side and the second end side to be in the form of a stepped side, wherein, on the second end side, the piston carries a sealing arrangement having at least one seal, which seals the first compression volume with respect to the second compression volume.

In particular, provision can be made for the seal to be formed via a profiled annular seal body having a circumferentially extending sealing first annular lip on an outer side of the seal and a circumferentially extending sealing second annular lip on an inner side of the seal.

Provision is advantageously made for the annular seal body to be formed as a sealing sleeve with a profile which is open in circumferential cross section, which has a profile base, and the profile wall of which is formed via the first annular lip and the second annular lip.

A pressure-tight configuration of the retention of the profile base between the piston ring and the retaining ring can expediently be configured in the manner explained as a preferred possibility in the context of the embodiments. A preferred embodiment, specifically of the anchoring or notching or similarly reinforced connection between the profile base, the piston ring and the retaining ring, is suitable for this purpose in principle.

Reinforced attachment of the profile base between the piston ring and the retaining ring preferably includes the profile base resting flat against a surface of the piston ring and a surface of the retaining ring, for example, embedding in the context of a mount. In addition, notching or guiding elements can be provided, which engage in an indentation or the like.

The profile base or correspondingly abutting surfaces of the profile against the corresponding piston surface or retaining ring surface can be slightly curved and, to this extent, can have a guiding action and, in addition, can nevertheless offer free space for a movement of the sealing lip.

In particular, the outer side of the seal, in particular of the sealing body, is in circumferential contact with a cylinder inner wall, and the inner side of the seal, in particular of the sealing body, is in circumferential contact with a web wall inner side of the cylinder.

In particular, provision is made for the seal to have an annular seal body with the first annular lip radially on the outside of the seal body and a second annular lip radially on the inside of the seal body. For this purpose, provision is advantageously made for the seal to have an annular seal body with:

- the first annular lip, which is arranged on the outside of the seal body in the radial direction, being directed toward the second compression volume in the axial direction, and/or
- with the second annular lip, which is arranged on the inside of the seal body in the radial direction, being directed toward the second compression volume in the axial direction.

In the context of an embodiment, it is envisaged that the retaining ring rests in the open profile of the sealing sleeve. This has the advantage that the retaining ring can, as it were, be fitted into the circumferential cross section of the open profile; to this extent, therefore, the retaining ring substantially follows the open profile corresponding to the circumferential cross section in its configuration.

For this purpose, the retaining ring can be rounded in the aforementioned manner on its base surface resting against the profile base in order, on the one hand, to allow the sealing lips to pivot and, on the other hand, like the base surface of the piston ring, to enable it to have further structural elements, which implement the sealing of the base surface of the retaining ring and the sealing of the piston ring with respect to the profile base.

It is likewise possible for the piston ring to have a base surface that is, as it were, gripping, which is correspondingly curved or arched. For example, the piston ring can have a substantially convex curvature on its base surface, and the retaining ring can have a correspondingly concave curvature on its base surface, or vice versa, with the result that the profile base of the profile of the sealing sleeve is held between these matching convexly or concavely curved base surfaces, which may be provided with free space.

In particular, the sealing sleeve, which is profiled in circumferential cross section, can be formed with a free cross section which is substantially U-shaped at the circumference, forming an open annular groove, the groove wall of which is formed via the first annular lip and the second annular lip. A groove which is U-shaped to this extent has proven particularly advantageous for accommodating the retaining ring. In particular, the first annular lip and the second annular lip can preferably be formed via the groove wall in order to form a pressure-tight radial sealing effect against a radial cylinder wall.

The sealing sleeve can advantageously be formed in one piece. The sealing sleeve can have the profile base between a first annular lip and a second annular lip, and at least one penetration opening may be formed in the profile base. However, the sealing sleeve can also be formed in multiple pieces. It is thus possible, in the context of a particularly preferred embodiment, to provide for the sealing sleeve to form the profile base between a separate part having a first annular lip and a separate part having a second annular lip, leaving a gap to form a penetration opening in the profile base. A corresponding further embodiment is shown in FIG. 7A, FIG. 7B.

In a particularly preferred embodiment, provision is also made for the sealing sleeve to have spaced-apart penetration openings in the profile base, and for the retaining ring to be connected to the piston ring via the fixing elements. Fundamentally, the fixing elements can advantageously be configured as required in order to connect the retaining ring to the piston ring via the fixing elements in such a way that the piston ring, which is arranged on the second end side with its profile base between the step-side retaining ring and the compression-volume-side retaining ring, is thereby held in a pressure-tight manner on the stepped side. The fixing elements can be produced from metal or plastic, for example, or from some other suitable synthetic material. As a particularly advantageous possibility, provision can be made for this purpose for the fixing elements generally to engage through the penetration openings of the sealing sleeve. In particular, it has proven advantageous for the sealing sleeve to have a number of penetration openings in the profile base which corresponds to the number of fixing elements, wherein each fixing element engages through one penetration opening.

In principle, one or more fixing elements can be formed on the piston ring or one or more fixing elements can be formed on the retaining ring or else, in a further modification, one or more fixing elements can be formed on the piston ring and the retaining ring, for example, can be integrally formed on one or both of these.

Thus, in a first modification, it has proven advantageous for the piston ring to have a first number of fixing elements and for the retaining ring to have a second number of fixing grooves in order to implement a connection, in particular a positive or nonpositive connection, between the piston ring and the retaining ring; the first and second numbers are preferably the same, but do not necessarily have to be the same. For example, a first number of fixing elements can be held in a common single annular groove or in a second number of fixing grooves, wherein each of the fixing grooves accommodates exactly one fixing element. A corresponding embodiment is shown in FIG. 4A, FIG. 4B, which allows both modifications. A corresponding further embodiment is shown in FIG. 6A, FIG. 6B or FIG. 7A, FIG. 7B. As can be seen, the sealing sleeve there has a corresponding number of openings for the number of fixing elements, and the piston ring has a number of fixing elements, and the retaining ring has the same number of fixing grooves, in order to implement a connection between the piston ring and the retaining ring. These embodiments enable comparatively simple installation of the seal system which is formed by the piston ring, the sealing sleeve and the retaining ring, the seal system furthermore being of particularly twist-proof configuration.

In a second modification, it has also proven advantageous for the retaining ring to have a first number of fixing elements and for the piston ring to have a second number of fixing grooves in order to implement a connection, in particular a positive or nonpositive connection, between the piston ring and the retaining ring. Here, too, the first and second numbers are preferably the same but do not necessarily have to be the same. For example, a first number of fixing elements can be held in a common single annular groove or in a second number of fixing grooves, wherein each of the fixing grooves accommodates exactly one fixing element. A corresponding embodiment is shown in FIG. 5A, FIG. 5B. This shows that the sealing sleeve there has a corresponding number of openings for the number of fixing elements, and the retaining ring has a number of fixing elements, and the piston ring has a number of fixing grooves, in order to implement a connection between the piston ring and the retaining ring. This embodiment enables comparatively simple installation of the seal system which is formed by the piston ring, the sealing sleeve and the retaining ring.

These and other variants have the advantage, in particular, that—in addition to holding the piston ring and the retaining ring together axially—namely in that the fixing elements engage through the penetration openings of the sealing sleeve, the sealing sleeve is held in a twist-proof manner between the piston ring and the retaining ring.

For this purpose, a fixing element can in principle expediently be configured in a variety of ways; for example, a comparatively secure configuration of a fixing element can be achieved in that the fixing element is formed as a clamping screw, wherein the clamping screw is screwed into a screw hole.

In particular, it may also be advantageous for a fixing element to be formed as a clamping tooth. The clamping tooth is advantageously configured to be held on a clamping stop or in a clamping fit. For this purpose, a clamping tooth can have a web-like configuration and have a clamping element or clamping catch on one web flank. The number of clamping teeth and/or the number of clamping grooves and/or the number of penetration openings are advantageously arranged along the circumference of the piston ring and/or retaining ring and/or sealing element. In a particularly advantageous manner, these are evenly spaced.

In particular, in a first modification, a clamping tooth is advantageously clamped in a clamping groove or fixed via an interference fit. A corresponding embodiment is shown in FIG. 4A, FIG. 4B and in FIG. 5A, FIG. 5B. In these aforementioned or similar embodiments, a radially outer surface and/or radially inner surface of a web flank of the clamping tooth can frictionally achieve an interference fit of the clamping tooth in a clamping groove with an opposite, radially outer surface and/or radially inner surface of a wall of the clamping groove, by way of the radially inner and/or radially outer surfaces.

In a second modification, a clamping tooth can pass through a clamping groove and be fixed via a clinch or rivet connection. A corresponding embodiment is shown in FIG. 6A and FIG. 6B. In these aforementioned or similar embodiments, a clamping tooth can have, at a distal end, a latching element, which has a clamping groove on a side facing away from the distal end, a corresponding undercut, in order to implement a connection in the manner of a clinch or rivet connection. Special rivets, such as small spiral rivets, can also be used to advantage.

In the context of a preferred embodiment, the piston ring can be arranged in that, in a first modification, it is secured on the second end side or, in a second modification, is formed in one piece with the latter. In particular, according to the first modification, this can be formed in one piece with the stepped side. In particular, it is possible, according to the second modification, for this to be formed separately and to be connected in a suitable manner to the stepped side; for example, it can be adhesively bonded, welded or connected materially in such a way. In simplified terms, the piston ring according to the first modification is advantageously formed as part of the piston directly on the piston and, according to the second modification, is advantageously connected in a fixed manner thereto.

In the context of a further preferred embodiment, at least one, in particular a number of one or more, sealing webs is advantageously formed on the piston ring and/or on the retaining ring, preferably at least one circumferential sealing web being formed. In particular, a sealing web can be arranged on the piston ring on the side facing the sealing sleeve and/or a sealing web can be arranged on the retaining ring on the side facing the sealing sleeve.

In this way, the sealing sleeve can be attached pressure-tightly to the piston ring and/or retaining ring in a particularly advantageous way via its profile base.

Advantageously, the sealing sleeve is also secured against an unintentional offset via a sealing web, that is, it is securely held in a position reliably predetermined by the sealing web. Overall, the sealing sleeve can be held pressure-tightly and securely on the stepped side in a particularly advantageous way via its profile base.

For example, in relation to the fixing element, a first sealing web can be arranged radially on the inside and, in comparison thereto, a second sealing web can be arranged radially on the outside relative to the fixing element. As a preferred option, it is possible in general for a number of sealing lips to be arranged offset in the radial direction with respect to one another and opposite one another on the piston ring and the retaining ring. As a preferred option, at least two, preferably circumferential, sealing webs of the piston ring and/or of the retaining ring are each arranged on the side facing the sealing sleeve.

In this regard, it has proven advantageous, in particular, for a sealing web on the retaining ring to be a radially inner sealing web, which is offset closer to the penetration opening than a sealing web on the piston ring, which, as a radially outer sealing web, is offset further away from the penetration opening in comparison.

In this regard, it is also possible in combination therewith, in a particularly preferred variant, with the same proviso, for a sealing web on the retaining ring to be a radially outer sealing web, which is offset closer to the penetration opening than a sealing web on the piston ring, which, as a radially inner sealing web, is offset further away from the penetration opening in comparison. In this particularly preferred variant, it is possible as it were for the sealing webs which are offset further away from the penetration opening to be arranged on the piston ring, and for the sealing webs which are offset closer to the penetration opening in comparison therewith to be arranged on the retaining ring.

In addition or alternatively to this, provision can also be made for a sealing web on the retaining ring to be a radially outer sealing web, which is offset further away from the penetration opening than a sealing web on the piston ring, which, as a radially inner sealing web, is offset closer to the penetration opening in comparison.

In this regard, it is also possible in combination therewith, in a particularly preferred variant of this alternative too, with the same proviso, for a sealing web on the retaining ring to be a radially inner sealing web, which is offset further toward the penetration opening than a sealing web on the piston ring, which, as a radially outer sealing web, is offset closer to the penetration opening in comparison. In this particularly preferred variant, it is possible as it were for the sealing webs which are offset further away from the penetration opening to be arranged on the retaining ring, and for the sealing webs which are offset closer to the penetration opening in comparison therewith to be arranged on the piston ring.

The piston ring and the retaining ring are each advantageously produced from a synthetic material; in particular, they are made of a synthetic material. The piston ring and the retaining ring can also advantageously be connected to one another and/or to the sealing sleeve via an adhesive joint and/or ultrasonically welded joint.

In particular, it has proven advantageous in the context of a further preferred modified embodiment, for the retaining ring—alternatively to a ring formed as a separate part—to be formed by filling a preferably U-shaped annular space of the sealing sleeve with synthetic material. This has the aforementioned advantage that a U-shaped groove, which is to this extent preferred, can accommodate the retaining ring. In particular, the first annular lip and the second annular lip can preferably be formed via the groove wall in order to form a pressure-tight radial sealing effect against a radial cylinder wall. In addition, it is advantageously possible in this modified embodiment for a retaining connection to be formed between the piston ring and the sealing sleeve and the retaining ring.

Irrespective of the above-explained arrangement or positioning of a sealing web and irrespective of the material of the piston ring and/or the retaining ring, it has proven advantageous for a sealing web to be configured in such a way that it presses completely or partially into the profile base of the sealing sleeve or can penetrate in another way into the profile base of the sealing sleeve or into the volume region thereof when the profile base is being fixed between the base side of the piston ring and the base side of the retaining ring. A sealing web is thus formed with an appropriately pointed penetration side, that is, advantageously a formed web edge toward the profile base of the sealing sleeve—for example ideally in the manner of a ridge. A hardness of the material, in particular the synthetic material, of the sealing web is advantageously greater than a hardness of the material, in particular the synthetic material, of the sealing sleeve or its profile base. Thus, the sealing web is generally and advantageously configured in such a way that, in order to connect the sealing sleeve by its profile base to the piston ring and/or retaining ring in a pressure-tight manner, it can deform the sealing sleeve; advantageously, however, it does not cut or cut into it so as to maintain its consistency.

Embodiments of the disclosure are now described below with reference to the drawing. These are not necessarily intended to represent the embodiments to scale; on the contrary, the drawing is executed in schematic and/or slightly distorted form, where useful for explanation. With regard to additions to the teachings directly recognizable from the drawing, attention is drawn to the relevant prior art. It should be borne in mind here that many modifications and changes relating to the form and detail of an embodiment can be made without departing from the general concept of the disclosure.

BRIEF DESCRIPTION OF DRAWINGS

The invention will now be described with reference to the drawings wherein.

DETAILED DESCRIPTION

Compressors according to the concept of the disclosure are preferably used in a compressed-air supply system—this has resulted in special requirements with regard to compression performance and compactness.

However, a compressor according to the concept of the disclosure can also be used for other types of compressed-air source. It should also be understood that the compressor can be used not only preferentially in compressed-air supply systems or for the passenger car or commercial vehicle sector. In addition, there have also been applications for vacuum generators, in particular vacuum pumps. A compressed-air supply system is shown by way of example as a preferred embodiment in FIG. 1 and is described below.

Figure 1:
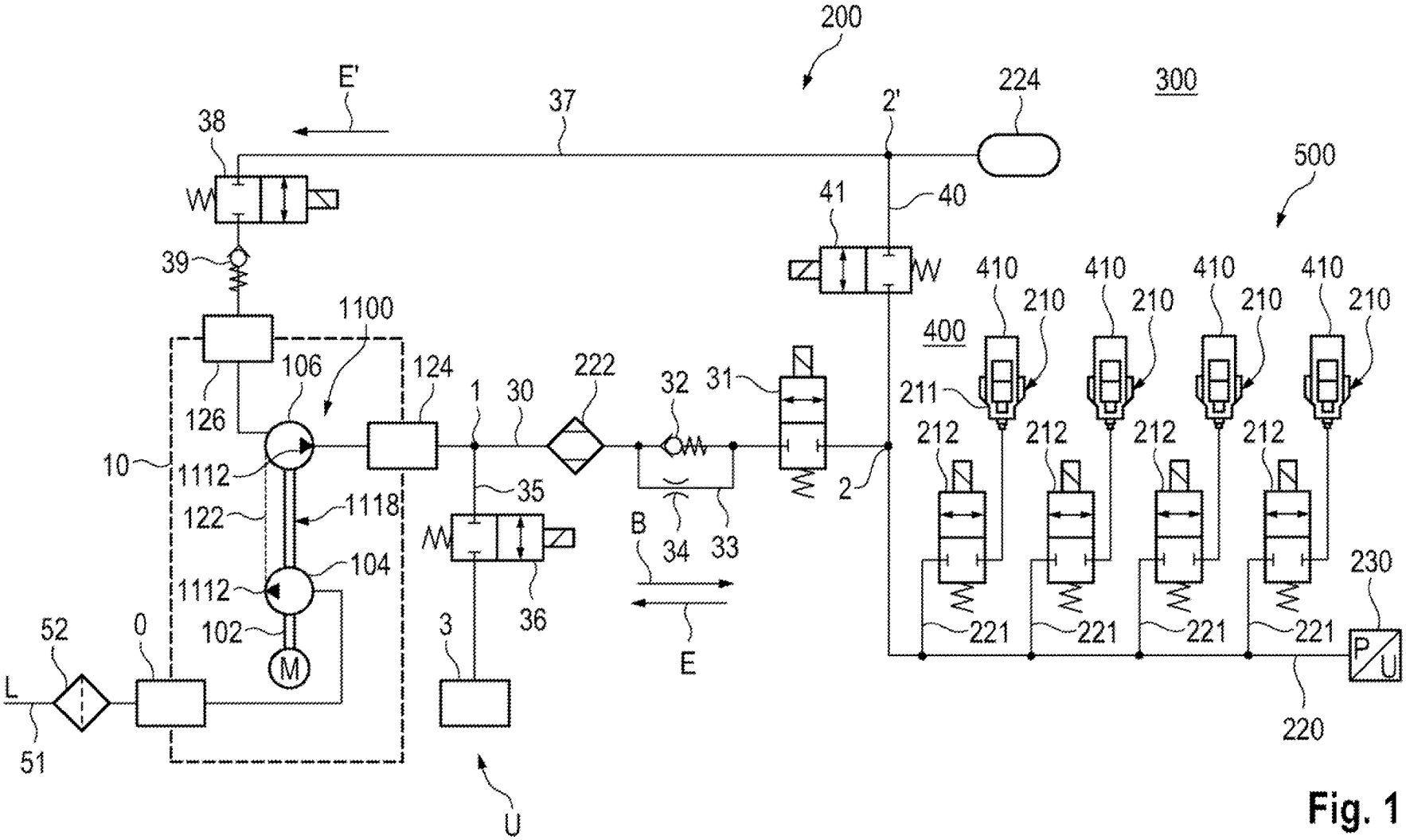
FIG. 1 shows a pneumatic circuit diagram of a pneumatic system known per se with a particularly preferred embodiment of a compressed-air supply system of the kind described in WO 2018/197182 A2, wherein a compressor is configured as a double compressor with a single piston in a single cylinder to form two compression volumes, and in which the piston according to the concept of the disclosure is preferably used.

FIG. 1 shows a pneumatic system 300 having a compressed-air supply system 200 and a pneumatic system 500, in the present case in the form of an air suspension system, of a vehicle 400 (not illustrated specifically).

In the present case, the air spring system is formed with an illustrative number of four air springs 210, wherein each air spring 210 is associated with one wheel of a vehicle 400 (not illustrated specifically). In the present case, the part of the vehicle 400 shown, in a purely symbolic way, is a support 410, which is formed in the vicinity of the wheel and can be raised when the air spring 210 is filled or lowered when the air spring 210 is vented. An air spring 210 includes an air bellows, referred to here as bellows 211, for holding compressed air and an air spring valve 212, which holds the compressed air quantity in the bellows 211 or releases it, or allows the bellows 211 to be filled with compressed air. The air spring valve 212 is formed as a controllable solenoid valve, here as a 2/2-way valve. In the present case, each of the air spring valves 212 is shown in a normally closed state owing to the spring force of a spring (not described in greater detail).

The air spring valves 212 are connected to a gallery line 220 configured as a manifold via suitable spring branch lines 221. Connected directly to the gallery line 220 is a voltage-pressure sensor 230, which is able to measure a pressure in the gallery line 220—and, given suitable switching of the air spring valves 212, also a pressure in the air springs 210. In conjunction with an accumulator system, that is, in the present case the accumulator 224, the pneumatic line 40 and the accumulator valve 41, the voltage-pressure sensor 230 can also measure an accumulator pressure. Pressure sensor signals can be transmitted to an air spring control system and/or a vehicle control system (not illustrated specifically in the present case) in order to initiate further control measures. In the present case, the pneumatic system 500 in the form of the air spring system is supplied with compressed air from the compressed-air supply system 200.

For this purpose, the pneumatic system 500 is connected to the compressed-air supply system 200 via a compressed-air connection 2. Compressed air can be fed to the compressed-air connection 2 via a pneumatic main line 30 from a compressed-air feed 10 having a compressor 1100. Compressed air can also be fed to the compressed-air connection 2 from a pressure medium reservoir 224 via a further compressed-air connection 2' and a further pneumatic line 40. The compressed-air supply system 200 has suitable isolating valves for the expedient selection of the type of feed of compressed air to the pneumatic system 500, namely a first isolating valve 31 in the pneumatic main line 30 and a second isolating valve 41 in the further pneumatic line 40. The first and second isolating valves 31, 41 are each configured as a controllable solenoid valve-here as a 2/2-way valve.

In FIG. 1, the first and second isolating valves 31, 41 are each shown in a closed state, thus completely isolating the pneumatic system 500 from the compressed-air supply system 200. This advantageously has the effect that an air dryer 222 of the compressed-air supply system is not adversely affected (for example, filled) by compressed air movements in the pneumatic system 500 or by the re-storage of compressed air from the pressure medium reservoir 224 in the pneumatic system 500 when the first isolating valve 31 is closed.

Overall, the compressed-air supply system 200 has a compressed-air feed 10 to which the main pneumatic line 30 is connected. In the pneumatic main line 30, the air dryer 222 is connected pneumatically in series on the compressed-air feed side and the first isolating valve 31 is connected pneumatically in series on the compressed-air connection side. A valve arrangement configured as a pneumatic parallel circuit is connected between the air dryer 222 and the first isolating valve 31.

The valve arrangement has a check valve 32, which opens automatically in the air admission direction B to the pneumatic system 500 and blocks in the venting direction E from the pneumatic system 500 to the air dryer 222. A restrictor 34, which allows bidirectional flow and acts as a regeneration restrictor, is arranged in a pneumatic line that is parallel to the main pneumatic line 30 and is connected as a bypass line 33. The restrictor 34 has a nominal width that is sufficient to provide a pressure drop when the pneumatic system 500 is vented with the first isolating valve 31 open such that an air dryer 222 sufficiently regenerates as part of a pressure swing adsorption process.

A compressed air flow guided in the venting direction E can be vented via a vent line 35 connected to the main pneumatic line 30 to a vent connection 3 leading to the environment U. A further isolating valve 36, which is to be opened for a venting process, is arranged in the vent line 35. Like the first and second isolating valves 31, 41, the further isolating valve 36 is configured as a controllable solenoid valve, namely here as a 2/2-way valve.

In a modification not shown here, a fundamentally different configuration of the pneumatic main line 30 and vent line 35 can also be provided, for example, with a suitable pilot-controlled solenoid vent valve arrangement or the like.

In the present case, the compressed-air feed 10 has a compressor 1100 configured according to the concept of the disclosure, which is described below with reference to the particularly preferred embodiment illustrated by way of example in FIG. 1, FIG. 2A and FIG. 2B. In the present case, the compressor 1100 of the compressed-air feed 10 is formed, with the compressed-air feed 10, as a device that can be connected separately to the compressed-air supply system 200.

The component of the compressed-air feed 10, which in this respect is to be referred to as a compressed-air feed device, has a compressed-air outlet 124, to which the main pneumatic line 30 of the compressed-air supply system 200 can be connected. Furthermore, the compressed-air feed 10 has a charging connection 126, to which a pneumatic line 37 leading to the pressure medium reservoir 224 can be connected via a still further isolating valve 38.

The pressure medium reservoir 224 is connected to the pneumatic line 37 via the abovementioned second compressed-air connection 2'. The further pneumatic line 40 leading to the compressed-air connection 2 is also connected to the second compressed-air connection 2'. When the still further isolating valve 38 is open, compressed air can flow through the pneumatic line 37 only unidirectionally, namely in a further venting direction E' as viewed from the pressure medium reservoir 224. For this purpose, the pneumatic line 37 has a further check valve 39, which opens automatically in the further venting direction E' and blocks in the opposite direction. The pneumatic line 37 is thus configured to feed compressed air from the pressure medium reservoir 224 to the charging connection 126 of the compressed-air feed 10 when the still further isolating valve 38 opens.

Furthermore, the compressed-air feed 10 has an air feed connection 0, via which air can be fed in from an air feed L—filtered in a filter 52 of an intake line 51.

As can be seen from FIG. 1, the compressor 1100 of the compressed-air feed 10 is configured with a first compression volume 104 and a second compression volume 106. According to the concept of the disclosure, the compressor 1100 in the embodiment described herein is embodied with a single cylinder 118, as described in more detail in FIG. 2A and FIG. 2B.

A single piston 1112 of the compressor 1100, which can be subjected to pressure on both sides in the interior of the cylinder 1118, is driven for movement by a motor M via a drive shaft 102. In the present case, the cylinder 1118 with piston 1112 of the compressor 1100 is arranged on a single side of the motor M to form both compression volumes 104 and 106; in particular, it is arranged on a single side of the drive shaft 102.

Figure 2B:
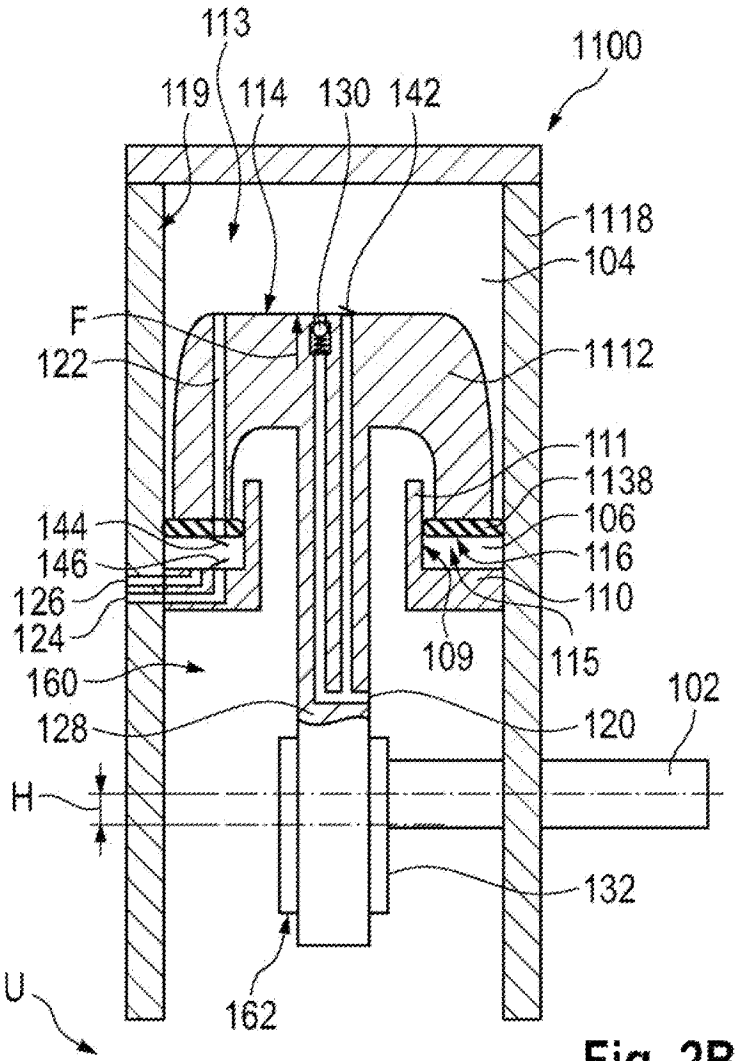
FIG. 2B shows a schematic sectional illustration of the compressor of FIG. 1 in a section plane parallel to both the drive and piston axes.
Figure 2A:
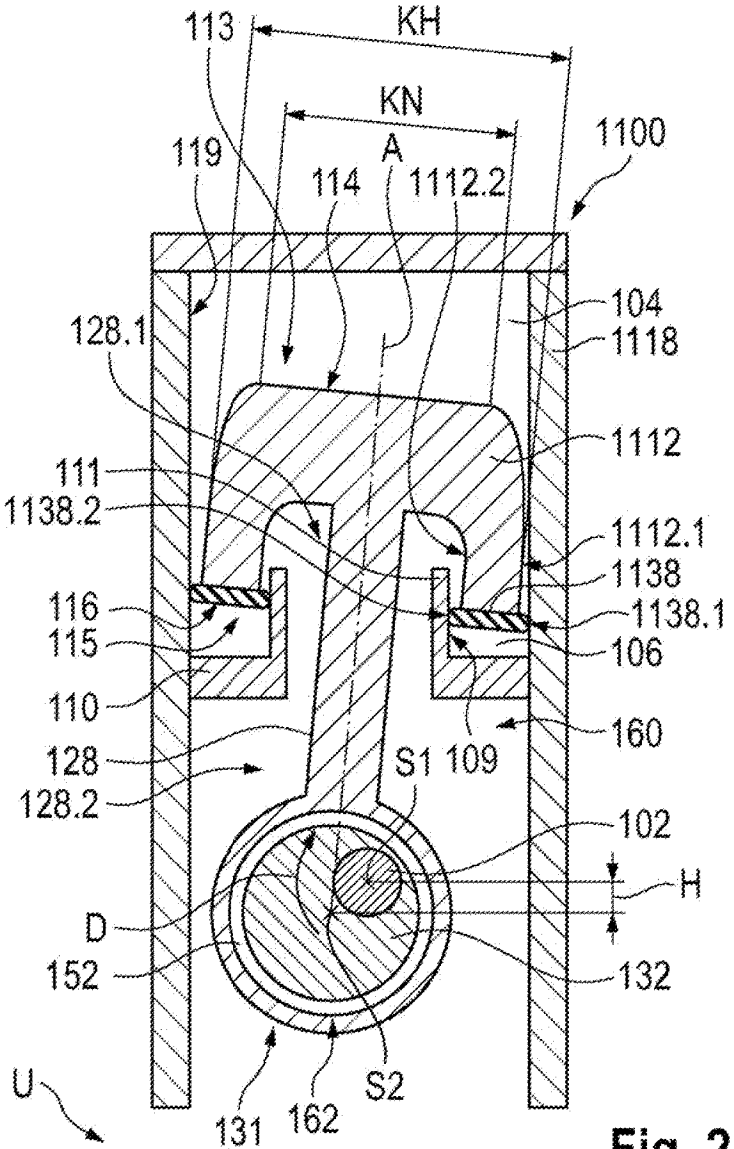
FIG. 2A shows a schematic sectional illustration of the compressor of FIG. 1 in a section plane perpendicular to the drive axis.

As can be seen from the description of FIG. 2A and FIG. 2B, this is a particularly compact arrangement of the cylinder 1118, using a single piston 1112.

The compressed-air feed or compressor 1100 has a connecting line 122 between the first compression volume 104 and the second compression volume 106. In the present case, the connecting line 122 is formed as a passage through a piston body of the piston 1112 and is therefore of particularly compact configuration. Owing to the comparatively short connecting line 122, the entire compression volume in the cylinder 1118 is kept small, thus enabling a particularly high compression pressure amplitude to be achieved.

If necessary, the availability of compressed air, that is, in particular, a compressed air quantity, can be increased even further by feeding further pressure medium to the second compression volume 106 via the second, optionally usable charging connection 126 and—in a so-called boost mode—further compressing it in the second compression volume 106 together with the compressed air of the first compression volume 104, which has been highly compressed, and making it available in the compressed-air outlet 124. Various embodiments that follow the concept of the disclosure are illustrated below for such a compressor 1100, for which further areas of application are conceivable in addition to the application illustrated in FIG. 1.

Figure 3B:
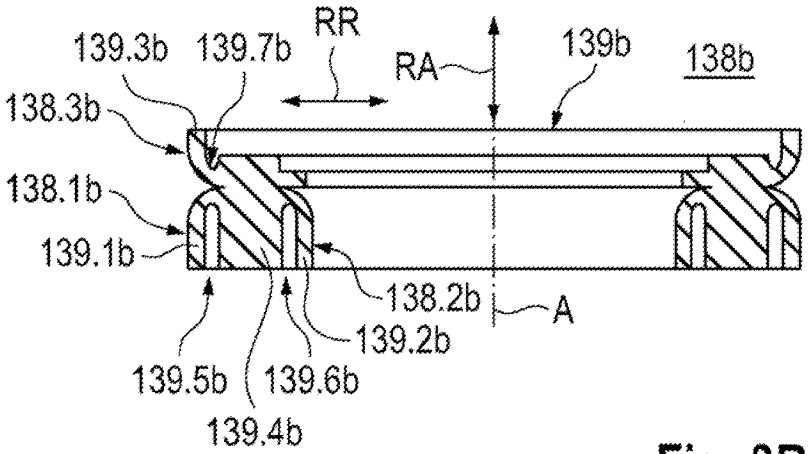
FIG. 3B shows a second version of a seal for a piston according to the prior art of the kind described in WO 2018/197182 A2, in a sectional view.
Figure 3A:
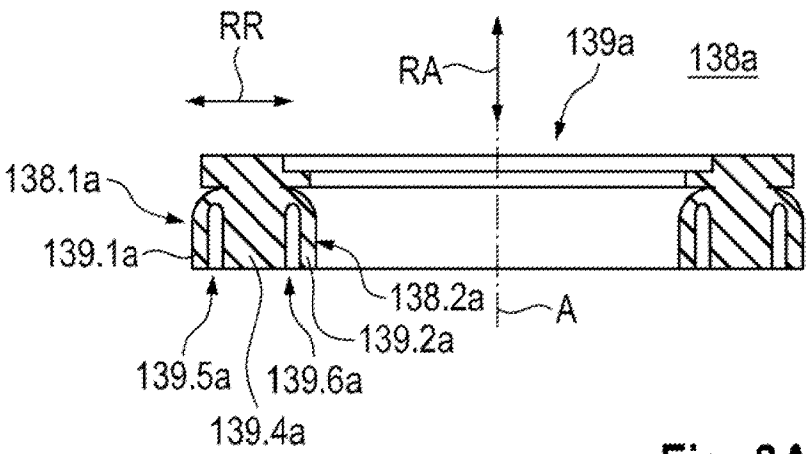
FIG. 3A shows a first version of a seal for a piston according to the prior art of the kind described in WO 2018/197182 A2, in a sectional view.

FIG. 2A shows a compressor 1100 according to one preferred embodiment in a first sectional view. A piston 1112 is arranged in a cylindrical cavity within a cylinder 1118. The piston 1112 is connected by a rigidly connected connecting rod 128, via a rotary connection 162 which allows rotary movement about an axis of rotation running through the point S2 perpendicularly to the section plane, to an eccentrically arranged shaft section 132, which in turn is connected to a drive shaft 102 in order to transmit the drive movement. In the present case, the piston 1112 and the connecting rod 128 are embodied in one piece, in particular joined together coaxially along a common piston axis A. The piston 1112 is also illustrated in a highly schematic way, as are other areas of this view. In particular, the configuration of the piston 1112 can deviate from the configuration shown here, in particular in order to implement functionally required wobble kinematics. Such deviating embodiments are shown in FIG. 3A, FIG. 3B and, in respect of the concept of the disclosure, in FIG. 4A.

In the present case, the rotary connection 162 is achieved via a connecting rod bearing 152. The drive shaft 102 and the eccentrically arranged shaft section 132 are part of a rotating part 131 of the drive.

The connecting rod 128 has a piston side 128.1 facing the piston 1112 and a drive side 128.2 facing the drive shaft 102.

The drive shaft 102, in turn, performs a rotary movement about an axis of rotation extending through a point S1 perpendicularly to the section plane. Owing to the rigid connection of the drive shaft 102 to the eccentrically arranged shaft section 132 and owing to the offset of the two points S1 and S2, a rotary movement of the drive shaft 102 leads to a deflection H of the piston in the stroke direction.

Furthermore, a rotationally symmetrical cylinder inner web 110 having an L-shaped cross section and extending radially inward from the cylinder inner wall 119 is arranged within the cylindrical cavity enclosed by the cylinder 1118. Owing to the L-shaped cross section, the cylinder inner web 110 has on its inner side a web wall 111 directed in the direction of the piston 1112. Thus, an annular space open in the direction of the piston 1112 is formed by the inner wall of the cylinder 1118 and the cylinder inner web 110, the space forming the second compression volume 106.

On the side facing away from the connecting rod 128, the piston 1112 has a first end side 113 configured as a full side 114, which, together with the inner wall of the cylinder 1118, delimits the first compression volume 104.

On the side facing the connecting rod 128, the piston 1112 furthermore has an annular piston step, which is formed in the form of a hollow cylinder, the outer wall of which is congruent with the outer wall of the piston 1112 at the level of the full side 114, and which is closed off on the side of the piston 1112 opposite the full side 114 by a second end side 115 configured as a stepped side 116.

The cylinder 1118 is furthermore configured in such a way that the piston 1112, in particular the side facing the connecting rod 128 with the stepped side 116, can move in an oscillating manner within the annular space formed by the cylinder inner web 110 and the inner wall of the cylinder 1118. The second compression volume 106 is formed by the boundary of the virtually annular space formed by the cylinder inner web 110, the inner wall of the cylinder 1118 and the stepped side 116.

The piston 1112 furthermore has a seal 138, which is shown schematically here and, in the embodiment shown schematically here and also in the preferred embodiments of FIGS. 4A to 10B, which will be explained below, is basically arranged at the end side on the stepped side 116 of the piston 1112 so as to form a sealing arrangement according to concepts of the disclosure.

The seal 1138 in the form of a sealing arrangement according to concepts of the disclosure—as illustrated in relation to the preferred embodiments of FIGS. 4A to 10B, which will be explained below—leads to improved sealing of the second compression volume 106 relative to the first compression volume 104 and of the compression volumes 104, 106 relative to a crankcase interior 160.

For this purpose, the seal 1138 basically has an outer side 1138.1 and an inner side 1138.2. The outer side 1138.1 of the seal 1138 is arranged at the outer circumference, that is, the outer side of the—by way of simplified description-annular seal 1138 as part of a sealing arrangement, which will be explained below, and thus establishes continuous circumferential contact with an cylinder inner wall 119, which, in particular, forms a cylindrical cavity. The inner side 1138.2 of the seal 1138 is arranged on the inner side, that is, at the inner circumference of the—by way of simplified description-annular seal 1138 and thus establishes continuous circumferential contact with a web wall inner side 109. Via the arrangement and configuration of the piston 1112, the cylinder 1118 and the cylinder inner web 110, it is therefore possible to accomplish the sealing of both compression volumes 104, 106 with a comparatively small number of seals or sealing arrangements, in particular just a single seal or sealing arrangement 1138.

FIG. 2A furthermore shows the relative inclination of the piston 1112 and the connecting rod 128, which is rigidly connected to the piston 1112, with respect to the cylinder 1118. This inclination is caused by the proportion of the offset, existing perpendicularly to the stroke direction, between the axis of rotation, running through point S1, of the drive shaft and the axis of rotation, running through point S2, of the rotary movement between the connecting rod 128 and the eccentrically arranged shaft section 132. This proportion of the offset that exists perpendicularly to the stroke direction is dependent on the angular position of the drive shaft 102 or of the eccentrically arranged shaft section 132. At the top or bottom dead center of the piston 1112, when the deflection H in the stroke direction is at a maximum, the proportion of the offset that exists perpendicularly to the stroke direction is equal to zero. On the middle of the path between the two dead centers of the piston 1112, when the deflection H in the stroke direction is equal to zero, the proportion of the offset that exists perpendicularly to the stroke direction is correspondingly at a maximum. The relative inclination of the piston 1112 or the connecting rod 128 with respect to the cylinder 1118 results in openings, in particular crescent-shaped gaps, between the piston 1112 and the inner wall of the cylinder 1118 or cylinder inner web 110. Such openings lead to an escape of compressed air from the second compression volume 106 into the first compression volume 104 and/or into the environment U or into a crankcase interior 160. To avoid this, or to compensate for the wobbling movement of the piston 1112, the seal 1138 is configured accordingly. This includes adequate dimensioning and elastic behavior of the seal 1138, ensuring that sealing of the compression volumes 104 and 106 continues to be maintained even when openings arise between the piston 1112 and the cylinder 1118 as a result of the wobbling movement.

FIG. 2B shows a further sectional view of a preferred embodiment of a compressor in a section plane parallel to both the drive axis and the piston axis A. The sectional view shows how air from the environment U or the crankcase interior 160 can pass into the first compression volume 104 via an air feed connection 120 arranged within the piston 1112 and the connecting rod 128. In this case, an air feed valve flap 142 arranged on the full side 114 of the piston 1112 ensures that air can only flow into the first compression volume 104 via the air feed connection 120, but not out. This is achieved by the air feed valve flap 142 closing counter to the rising pressure in the first compression volume 104 during the reduction of the first compression volume 104 caused by the deflection H and the associated compression of the air located therein. Accordingly, the air feed valve flap 142 opens as the first compression volume 104 is enlarged owing to the reduced pressure prevailing in the first compression volume 104 relative to the environment, with the result that air flows from the environment or the crankcase interior 160 into the first compression volume 104.

Furthermore, a check valve 130, which is held in the closed state by a spring force F, is arranged within the piston 1112 as a further connection between the first compression volume 104 and the air feed connection 120 or the crankcase interior 160. The check valve 130 thus enables air in the first compression volume 104, the pressure of which exceeds a certain maximum value, in particular one that is potentially damaging to the compressor, to escape into the environment via the air feed connection 120. Alternatively, the check valve 130 can also be arranged in such a way that the air escapes directly into the crankcase interior 160 or the environment U, that is, without being guided via the air feed connection 120.

A connecting line 122 is furthermore arranged within the piston 1112 between the first compression volume 104 and the second compression volume 106. This connecting line 122 forms a gas-conducting connection of the two compression volumes 104 and 106. In the present case, analogously to the air feed valve flap 142, it has a connecting valve flap 144, which ensures that air flows through the connecting line 122 in only one direction, namely from the first compression volume 104 to the second compression volume 106. Accordingly, the connecting valve flap 144 closes counter to the rising pressure as the second compression volume 106 is reduced in size, and opens during enlargement, thus enabling air to flow from the first compression volume 104 into the second compression volume 106. The air compressed in the second compression volume 106 can be made available to consumers of a pneumatic system 500 via a compressed-air outlet 124, in particular via a compressed-air supply system 200.

Also arranged in the cylinder 1118 is a charging connection 126, which leads to the second compression volume 106 and has a charging valve flap 146. Via the charging connection 126, the second compression volume 106 can be fed with air which was compressed at a previous time, for example, and is stored and held ready in a pressure medium reservoir 224.

In this way, the power of the compressor 1100 can be briefly increased, in particular in order to make compressed air available more quickly. Here, the charging valve flap 146 ensures that air flows exclusively into the second compression volume 106 via the charging connection 126 and cannot escape via the charging connection 126.

Furthermore, the piston 1112 does not have a cylindrical shape but a cross section that is variable along a piston axis A. In this embodiment, the piston 1112 has a cross section with a piston secondary diameter KN at the level of the full side 114. On the stepped side 116, in contrast, the piston 1112 has a piston main diameter KH which is greater than the piston secondary diameter KN. Owing to these different diameters and the profile of the piston diameter between the stepped side 116 and the full side 114, there is a variable, substantially non-cylindrical profile of both an outer side 1112.1 and an inner side 1112.2 of the piston 1112, which results in the piston 1112 being virtually dome-shaped. In particular, such a configuration ensures mobility of the piston 1112 within the cylinder 1118, in particular despite the wobbling movement of the piston 1112.

The piston main diameter KH may not be greater than the diameter of the cylinder 1118, but it is possible and even expedient if the diameter of the outer side 138.1 of the seal 138 is greater than the piston main diameter KH and also than the diameter of the cylinder 1118. This makes it possible for the piston 1112, together with the seal 138, to produce a seal between the first compression volume 104 and the second compression volume 106 or between the second compression volume 106 and the crankcase interior 160, despite the wobbling movement of the piston 1112 and the resulting openings and gaps between the piston 1112 and the cylinder 1118 or the piston 1112 and the web wall 111.

At the same time, despite the larger diameter of the outer side 1138.1 of the seal 1138, the movement of the piston 1112 is not significantly impeded or blocked since the seal 1138 of the sealing arrangement according to concepts of the disclosure is preferably formed from an elastic material.

In the present case, the shape of the piston 1112 is of virtually dome-shaped configuration, and therefore the piston is configured to match a dome-shaped section 164 of the cylinder 1118. The piston 1112 has an outer side 1112.1 and an inner side 1112.2. In particular, owing to its dome-shaped configuration, the piston 1112—analogously to the embodiment shown in FIGS. 3A and 3B—is suitable, in spite of its wobble kinematics, for moving in a predominantly cylindrical or—as in the present case—dome-shaped interior of a cylinder 1118. Also readily visible is the seal 138 with an outer side 138.1 and an inner side 138.2. Here, the outer side 138.1 is in circumferential contact with a cylinder inner wall 119 over the outer circumference of the seal 138, thus bringing about a pressure-tight seal with respect to a first compression volume 104. The inner side 138.2 of the seal 138 is circumferentially in contact with a web wall inner side 109 over the inner circumference of the seal 138, thus bringing about a pressure-tight seal with respect to a crankcase interior 160. In the present case, the piston 1112, in particular the coupling section 164 of the piston 1112, is furthermore secured on a connecting rod 128 via a piston screw 166. Only the piston side 128.1 of the connecting rod 128 is visible in the present view.

It is furthermore possible, in particular, to provide a check valve 130, an air feed connection 120, a connecting line 122, an air feed valve flap 142, a connecting valve flap 144, a charging valve flap 146, and a compressed-air outlet 124 and a charging connection 126. These features correspond essentially to the features already symbolically represented in FIG. 2B.

In contrast to the embodiment illustrated in FIG. 2B, the air feed valve flap 142 and the check valve 130 are not jointly connected to an air feed connection 120 passed through a connecting rod 128, as illustrated in FIG. 2B, but are arranged separately in the piston 1112 and are connected in a gas-conducting manner to a crankcase interior 160—or, in the case of the check valve 130, can be connected as a function of the spring force.

Even if, in the embodiment described here, the connecting line 122 provides for series connection of the first compression volume 104 and the second compression volume 106—generally in the form of a series connection of two compressor stages of what is thus a multi-stage compressor—it should nevertheless be understood that concepts of the disclosure are not limited thereto. Alternatively, in another embodiment, the concepts of the disclosure can also be implemented in a multi-stage compressor whose two or more compressor stages are implemented in the form of a parallel connection—generally, therefore, in the form of a parallel connection of two compressor stages of what is thus a multi-cylinder compressor.

FIG. 3A shows a first version, known per se from WO 2018/197182 A2, of a seal 138*a* which corresponds substantially to a previously described seal 138.

The seal 138*a* includes a seal body 139*a* which has a first annular lip 139.1*a* and a second annular lip 139.2*a*. The first annular lip 139.1*a* is arranged on the outside of the seal body 139*a* in a radial direction RR in such a way that it extends in an axial direction RA in the direction of a second compression volume 106. In particular, the first and/or second annular lip 139.1*a*, 139.2*a* have/has a free end that is arranged in the second compression volume 106.

The second annular lip 139.2*a* is arranged on the inside of the seal body 139*a* in a radial direction RR. It too extends in an axial direction RA in the direction of the second compression volume 106. The seal body 139*a* is secured on a stepped side 116 of a piston 1112.

FIG. 3B shows a further version of a seal 138*b* known per se from WO 2018/197182 A2. The essential difference between seal 138*b* and seal 138*a* shown in FIG. 3A is that—in addition to a first annular lip 139.1*b* and a second annular lip 139.2*b*—a seal body 139*b* of seal 138*b* has an additional third annular lip 139.3*b*, which is arranged on the outside of the seal body 139*b* in a radial direction RR and is directed in an axial direction RA toward the first compression volume 104. In particular, the third annular lip 139.3*b* has a free end which is arranged in the first compression volume 104.

The embodiment of the seal 1138 of the sealing arrangement according to concepts of the disclosure, which is a further preference that goes beyond the above, will be explained in more detail with reference to preferred embodiments of a piston of FIG. 4A to FIG. 10B.

The seal 1138 of the sealing arrangement according to concepts of the disclosure proves to be a further improvement for implementing a function of a powerful, in particular two-stage, compressor in a configuration that is as compact and robust as possible.

Figure 9:
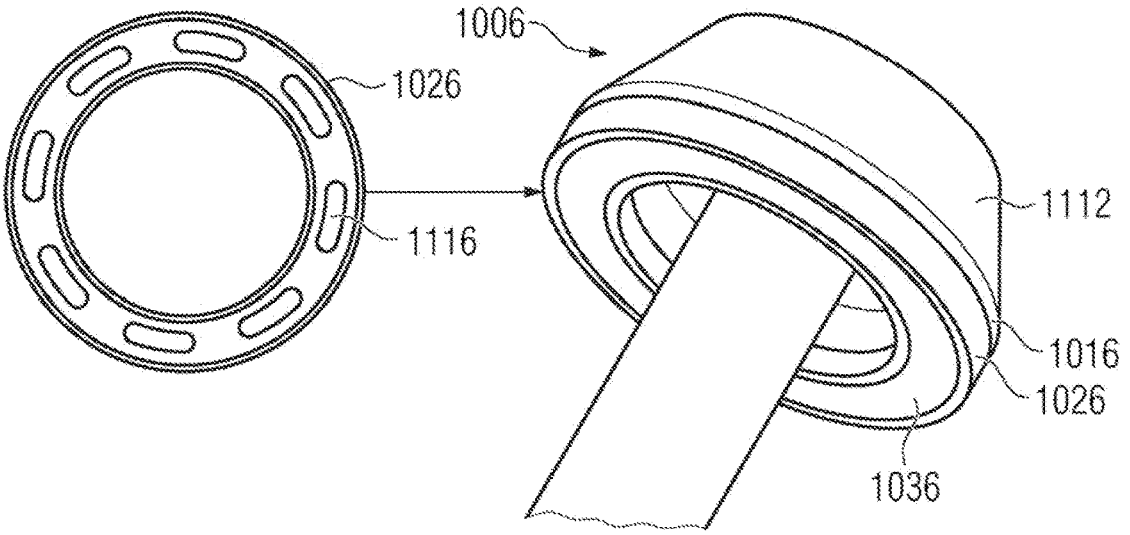
FIG. 9 shows a piston according to the concept of the disclosure in a sixth embodiment in a disassembled perspective view for a schematically shown compressor in the form of a double compressor according to the model of FIG. 2A, FIG. 2B.
Figure 10A:
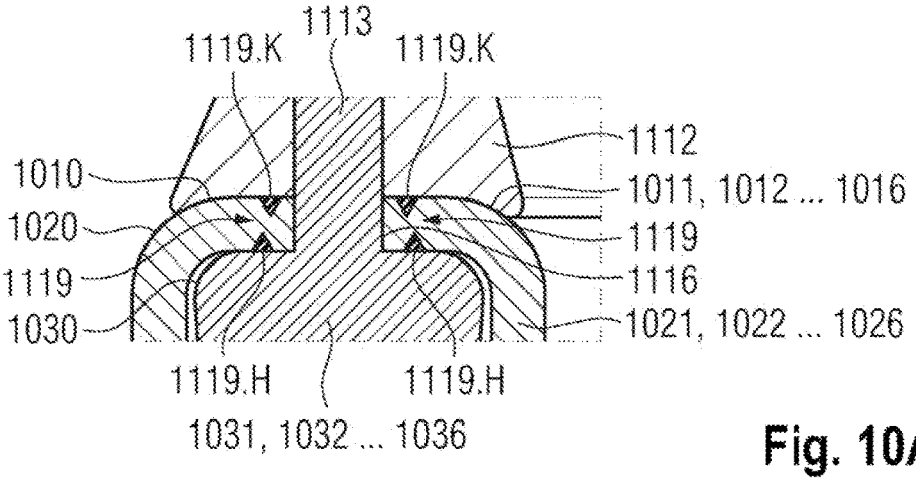
FIG. 10A, FIG. 10B each show in a sectional view, generally independently of the previously explained embodiments, some variants of an implementable profile base of an annular seal body of a sealing sleeve with sealing webs.
Figure 10B:
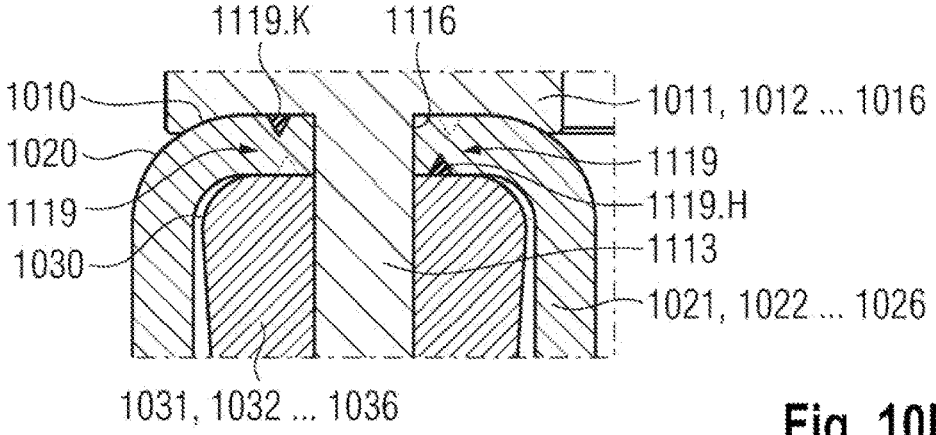
Figure 11A:
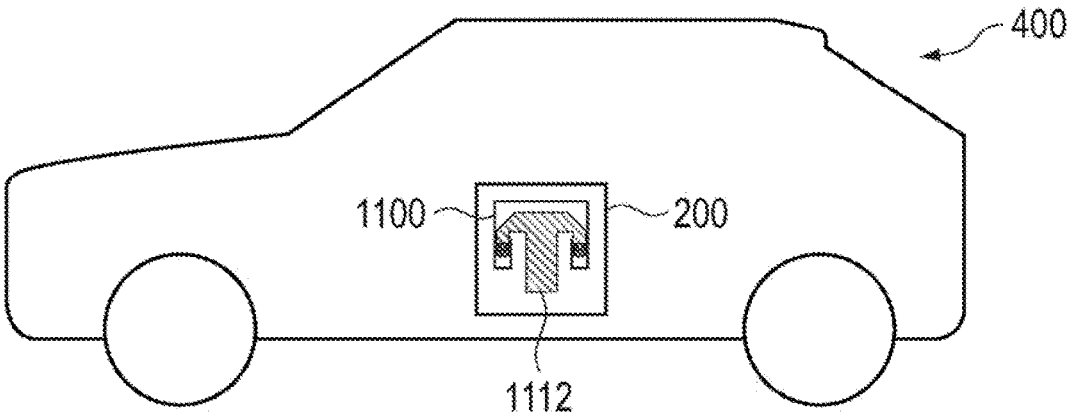
FIG. 11A shows a vehicle of any type, for example, a passenger car or a commercial vehicle such as a truck or a trailer (not illustrated), in a schematic illustration with a pneumatic system known per se with a particularly preferred embodiment of a compressed-air supply system of FIG. 1, wherein a compressor is configured as a double compressor with a single compression volume, and in which a piston according to the concept of the disclosure is preferably used; the piston can be configured according to the concept of the disclosure in a first, second or third or fourth embodiment as shown in FIG. 4A to FIG. 7C; and, FIG. 11B shows a vehicle in the form of a passenger car in a schematic illustration with an electronically controlled air supply system (ECAS, Electronically Controlled Air Suspension), which is equipped with a particularly preferred embodiment of a compressed-air supply system of FIG. 1 and is shown here in a realistic perspective view.
Figure 11B:
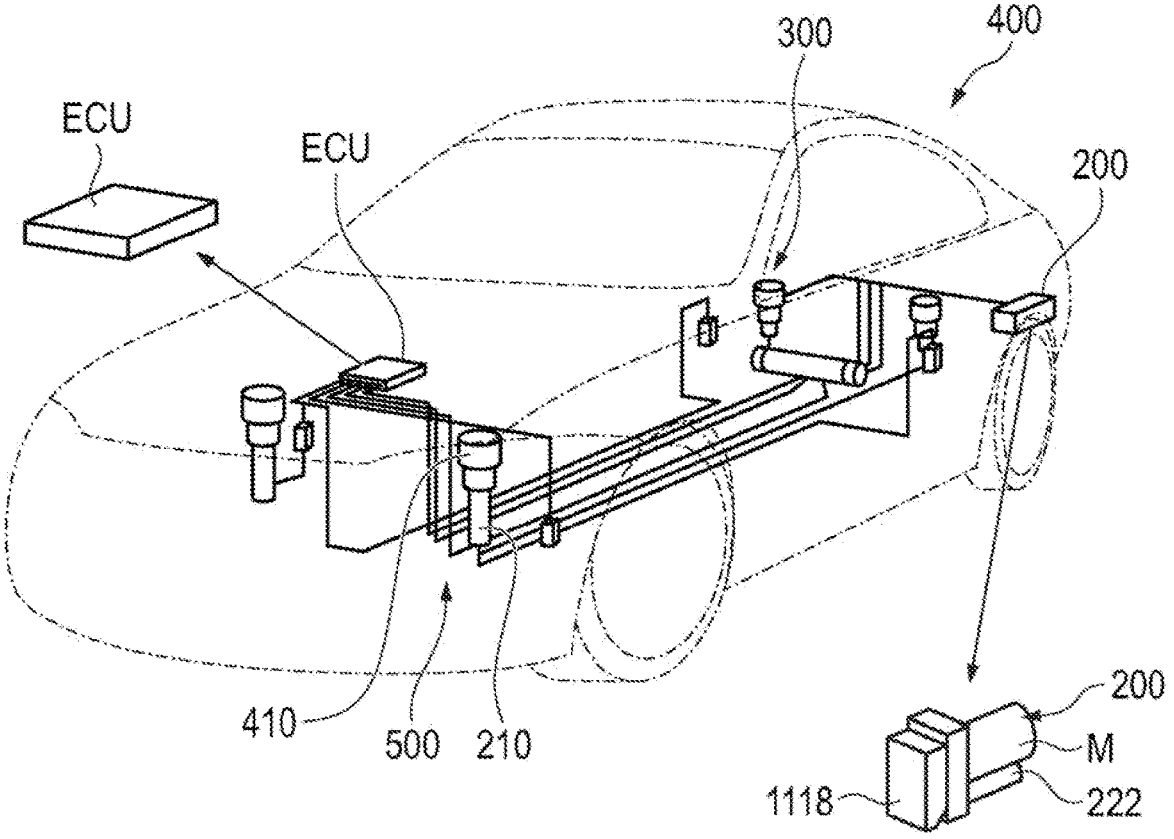

That is, the embodiments of a piston of FIG. 4A to FIG. 10B are preferably configured for a compressor 1100, in particular an air compressor, for a compressed-air feed 10 of a compressed-air supply system 200 as shown in FIG. 1, or for operating a pneumatic system 500 as furthermore shown in FIG. 11B with reference to a compressed-air supply system of FIG. 11A.

Figure 8:
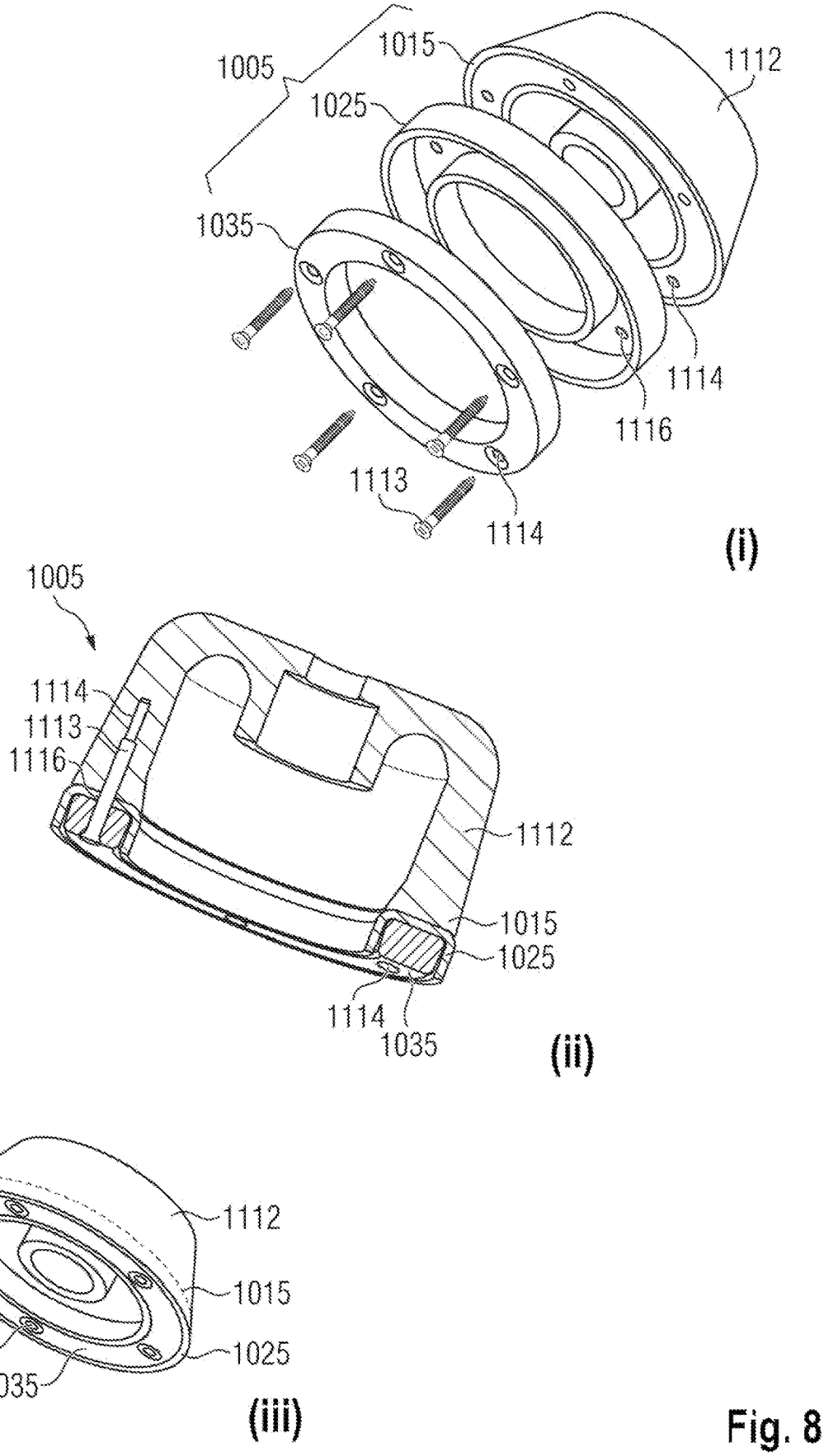
FIG. 8 shows a piston according to the concept of the disclosure in a fifth embodiment in a sectional view, also illustrated in an exploded view with screws and in an assembled perspective view for a schematically shown compressor in the form of a double compressor according to the model of FIG. 2A, FIG. 2B.

Here and below, for the sake of simplicity, the same reference sign is used for the same or similar features or features with the same or a similar function; however, a distinction is made specifically between the embodiments of a sealing arrangement 1001, 1002, 1003, 1004, 1005, 1006 corresponding to the further FIG. 4A and FIG. 4B, FIG. 5A and FIG. 5B, FIG. 6A and FIG. 6B, FIG. 7A and FIG. 7B, FIG. 8 and FIG. 9; the refining variants of FIG. 10A, FIG. 10B are configured to be equally advantageous for all embodiments. However, all the embodiments of the sealing arrangement 1001, 1002, 1003, 1004, 1005, 1006 implement concepts of the disclosure with the above-explained advantages of the disclosure and of the embodiments of the disclosure.

Figure 4A:
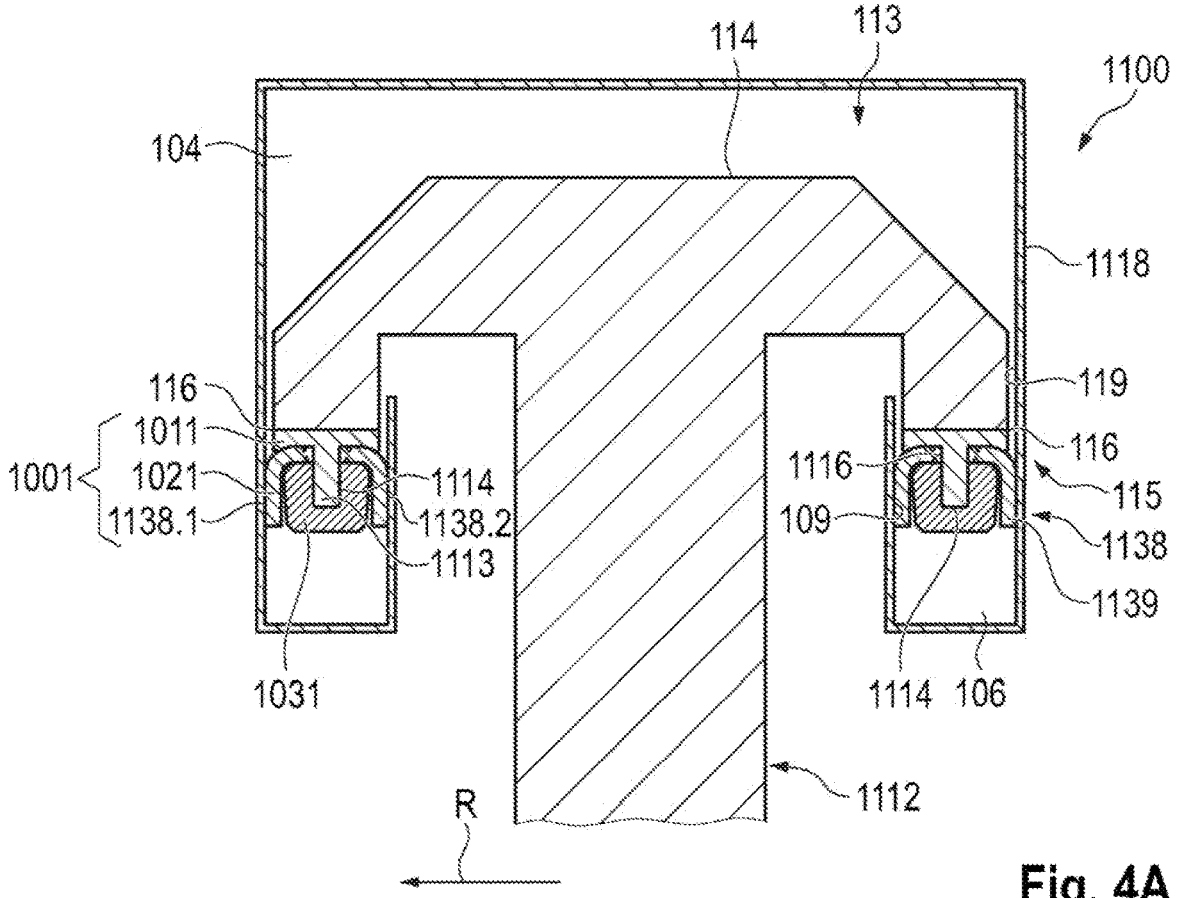
FIG. 4A shows a piston according to the concept of the disclosure in a first embodiment in a sectional view, illustrated in a schematically shown compressor in the form of a double compressor according to the model of FIG. 2A, FIG. 2B.
Figure 4B:
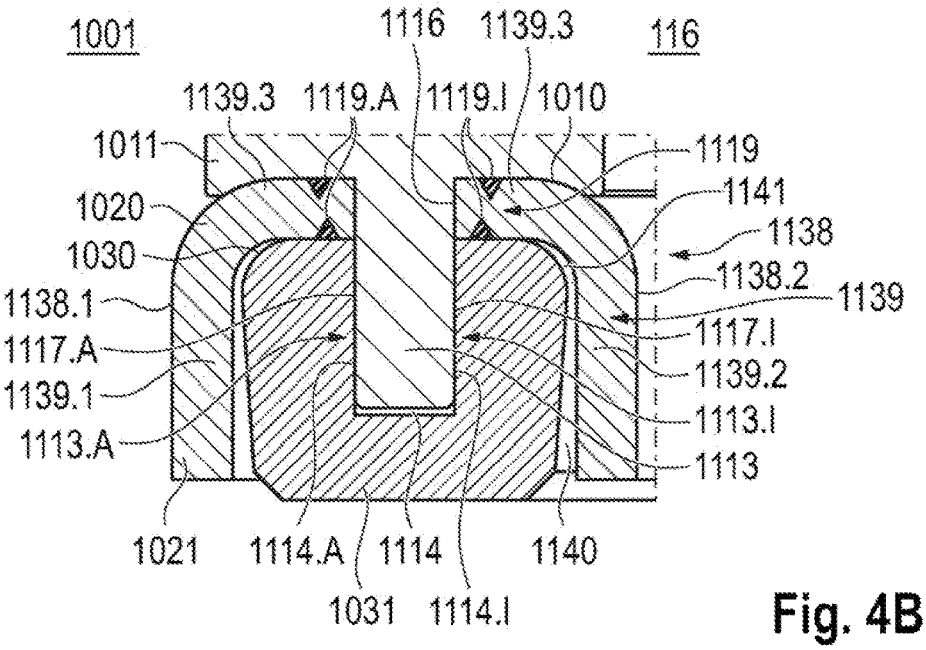
FIG. 4B shows a detail of the piston of the first embodiment according to FIG. 4A in the region of the seal.

In this regard, FIG. 4A and FIG. 4B show in detail a particularly preferred first embodiment of a sealing arrangement 1001 having an annular seal body 1139 in the form of a sealing sleeve 1021, a compression-volume-side retaining ring 1031 in the sealing sleeve, and a step-side piston ring 1011; this is for mounting on a second end side 115 of the piston 1112, which is embodied as a stepped side 116.

In the present case, the piston 1112 is shown in a schematically illustrated cylinder 1118 with a schematically illustrated cylinder inner wall 119. The first end side 113 of the piston can be seen to be configured as a full side 114.

Thus, the piston 1112 is shown schematically in the cylinder 1118 in FIG. 4A—using the same reference signs as above—for the same or similar features or features of the same or similar function, forming a first compression volume 104 and a second compression volume 106, which are sealed with respect to one another via the sealing arrangement 1001 according to the first embodiment.

All the preferred embodiments of the sealing arrangement 1001, 1002, 1003, 1004, 1005, 1006 implement the following features explained by way of example using the first sealing arrangement 1001, in a type of sandwich structure.

In the present case, according to the concept of the disclosure, the sealing arrangement 1001 has the sealing sleeve 1021, profiled in circumferential cross section, between the step-side piston ring 1011 and the compression-volume-side retaining ring 1031. In the present case, the sealing arrangement 1001 according to the first and further embodiments therefore has a step-side piston ring 1011 and, in order to form the annular seal body 1139, a sealing sleeve 1021 and retaining ring 1031 according to the first embodiment.

The sealing arrangement 1001 according to the first embodiment is illustrated in detail in FIG. 4B. The annular seal body 1139 of the sealing sleeve 1021 forms the above-explained first annular lip 1139.1 on an outer side 1138.1 of the seal 1138 and the second annular lip 1139.2 on the inner side 1138.2 of the seal 1138. The sealing sleeve 1021 is thus formed as an annular seal body 1139, with a circumferential cross section shown in FIG. 4B, which can be seen to form the open profile 1020; here, the opening 1140 in the profile can be seen to be substantially rectangular, wherein the first and second annular lips 1139.1, 1139.2 merge via a rounded portion 1141 into the profile base 1139.3. The profile wall of the profile 1020 provided with the profile opening 1140 is thus formed via the first and second annular lips 1139.1, 1139.2 and merges in a rounded manner into the profile base 1139.3. This is the case over the entire circular-ring-shaped annular circumference of the sealing sleeve 1021.

Likewise in the present case—as also in the case of the further embodiments of a further sealing arrangement 1001, 1002, 1003, 1004—the profiled sealing sleeve 1021—that is, like the further embodiments of the sealing sleeve 1022, 1023, 1024—is formed with a substantially U-shaped free cross section of the profile opening 1140 at the circumference, forming what is to this extent an open annular groove, that is, an annular groove open to the second compression volume 106, the groove wall of which is formed via the aforementioned first and second annular lips 1139.1, 1139.2 and the base of which is formed with the aforementioned profile base 1139.3.

Here, as in the other embodiments of the sealing arrangement 1001, 1002, 1003, 1004, the sealing sleeve 1021, 1022, 1023, 1024 is held in a pressure-tight manner at the profile base 1139.3 on the stepped side 116 of the piston, between the step-side piston ring 1011, 1012, 1013, 1014 and the compression-volume-side retaining ring 1031, 1032, 1033, 1034; this too is the case in all three embodiments of the sealing arrangement 1001, 1002, 1003, 1004, this being made clear in this respect by the same reference signs.

Likewise, as can be seen in FIG. 4B, FIG. 5B, FIG. 6B, FIG. 7B and FIG. 8 and FIG. 10A, FIG. 10B, it can be seen for all the embodiments of the sealing arrangement 1001, 1002, 1003, 1004, 1005, 1006 in respect of the profile base 1139.3 of the profile 1020 that these are held between a concavely curved adjacent sealing side 1010 of the piston ring 1011, 1012, 1013 and a matching convexly arched retaining side 1030 of the retaining ring.

The rounded portion 1141 of the profile opening 1140 thus provides space for the transition of the sealing lips 1139.1, 1139.2 to the profile base 1139.3 in such a way that the curvature of the sealing sleeve 1021, 1022, 1023, 1024 can move between the convex curvature of the sealing side 1010 on the piston ring 1011, 1012, 1013 and the retaining side 1030 on the retaining ring 1031, 1032, 1033, or can adjust elastically to maintain the sealing effect. It can thus be understood that the curvature of the profile 1020 of the sealing sleeve 1021, 1022, 1023, 1024 is guided between the convex shape of the retaining side 1030 of the retaining ring 1031, 1032, 1033, 1034 or the sealing side 1010 of the piston ring 1011, 1012, 1013, 1014.

These, as well as the following features of the profile base 1139.3, are implemented in all the embodiments, and, in this respect, this is made clear by the use of the same reference signs.

The material of the profile base 1139.3 is configured to be sufficiently soft or elastic to receive the sealing webs 1119, which are here configured as sealing blades. The sealing webs 1119 are thus pressed into the profile base 1139.3 when fixing the profile base between the base side of the piston ring 1011, 1012, 1013 and the base side of the retaining ring 1031, 1032, 1033. The sealing webs 1119 serve to improve the sealing of the sealing sleeve 1021, 1022, 1023, 1024 at its profile base 1139.3 between the sealing side 1010 of the piston ring 1011, 1012, 1013 and the retaining side 1030 of the retaining ring 1031, 1032, 1033.

Moreover, as in all the embodiments of the sealing arrangement 1001, 1002, 1003, the profile base 1139.3 has penetration openings 1116 spaced apart along the annular circumference of the sealing sleeve. The sealing webs 1119 are formed on the sealing sleeve 1021, 1022, 1023 in order to form indentations in the profile base 1139.3 of the profile 1020. That is, in concrete terms, two small sealing blades (for example approximately 0.3 mm high), identifiable as small triangles, are formed circumferentially on the piston ring 1011, 1012, 1013 and on the retaining ring 1031, 1032, 1033, and are intended to press into the profile base 1139.3 of the profile 1020 of the sealing sleeve 1021, 1022, 1023, 1024 and thereby assist with sealing. The piston ring and the retaining ring are manufactured from aluminum and are to be sealed via the sealing blades.

The sealing webs are formed, on the one hand, on the outside as 1119.A and, on the other hand, on the inside as 1119.I, in order to increase the sealing effect; as explained above, this is done with the sealing webs 1119.A or 1119.I, respectively on the side of the piston ring 1011, 1012, 1013 and of the retaining ring 1031, 1032, 1033. That is, a first sealing web 1119.I is provided radially on the inside and a second sealing web 1119.A is provided radially on the outside in relation to the aforementioned sealing opening 1116. A first radially inner sealing web 1119.I is provided in each case on the piston ring 1011, 1012, 1013 and the retaining ring 1031, 1032, 1033; if appropriate, it can also be provided only on a piston ring or only on a retaining ring. Similarly, a second sealing web 1119.A can be provided radially on the outside of the piston ring 1011, 1012, 1013 and the retaining ring 1031, 1032, 1033, or only on the piston ring or only on the retaining ring.

In the present case, the formation of in each case two circumferential sealing webs 1119.A or two circumferential sealing webs 1119.I has proven advantageous, and therefore the piston ring 1011, 1012, 1013 has two circumferential sealing webs 1119.I, 1119.A and the retaining ring 1031, 1032, 1033 likewise has two circumferential sealing webs 1119.I, 1119.A, wherein in each case one of the circumferential sealing webs 1119.I, 1119.A is arranged radially inside the penetration openings 1116 and one is arranged radially outside the penetration openings 1116.

In the present case, it has also proven advantageous for the radially inner sealing webs 1119.I to be arranged offset relative to one another, wherein the sealing web 1119.I of the retaining ring 1031, 1032, 1033 is offset radially somewhat outward, that is, closer to the penetration opening 1116. In contrast, the radially inner sealing web 1119.I of the piston ring is offset radially somewhat inward in comparison to the sealing web 1119.I of the retaining ring.

However, both sealing webs 1119.I are offset with their apex ridges only to an extent such that they still overlap; in the present case, the apex ridge of one sealing web 1119.I lies opposite a flank of the other sealing web 1119.I. In the same way, a sealing web 1119.A of the retaining ring is offset radially somewhat closer to the penetration opening 1116, that is, offset radially further inward, in comparison with the sealing web 1119.A of the piston ring, which is offset radially somewhat outward. Both sealing webs 1119.A overlap insofar as their apex ridges are each arranged opposite a flank of the opposite sealing web 1119.A. This arrangement of the sealing webs 1119.A 1119.I—and likewise in all three embodiments of the sealing arrangement 1001, 1002, 1003, 1004—is implemented in order to increase the sealing effect at the profile base 1139.3 of the sealing sleeve between the piston ring and the retaining ring.

Irrespective of the above-explained arrangement or positioning of a sealing web 1119, 1119.A 1119.I and irrespective of the material of the piston ring 1011, 1012, 1013 and/or the retaining ring 1031, 1032, 1033, it has proven advantageous for a sealing web 1119.A 1119.I to be configured in such a way that it presses completely or partially into the profile base 1139.3 of the sealing sleeve 1021, 1022, 1023 or can penetrate in some other way into the profile base 1139.3 of the sealing sleeve 1021, 1022, 1023 or into the volume region thereof when the profile base 1139.3 is being fixed between the base side of the piston ring 1011, 1012, 1013 and the base side of the retaining ring 1031, 1032, 1033. Thus, a sealing web is formed with an appropriately pointed penetration side, that is, advantageously a formed web edge toward the profile base of the sealing sleeve-ideally, for example, in the manner of a ridge, for example, of the aforementioned apex ridges. A hardness of the material, in particular the synthetic material, of the sealing web is advantageously greater than a hardness of the material, in particular the synthetic material, of the sealing sleeve or its profile base. Thus, the sealing web 1119, 1119.A, 1119.I is generally and advantageously configured in such a way that, in order to connect the sealing sleeve by its profile base 1139.3 to the piston ring and/or the retaining ring in a pressure-tight manner, it can deform the sealing sleeve; advantageously, however, it does not cut it so as to maintain its consistency.

In the present case, the penetration openings 1116 are formed in the profile base 1139.3 for penetration by a fixing element, which, like the number of penetration openings 1116 in the profile base, are arranged circumferentially in a ring on the retaining ring and/or the piston ring. In principle, a fixing element can be configured in any suitable manner as a rounded, oval or even circumferentially extending, more or less wide stud, pin, peg or else a partial or full circumferential web that is relatively wide in comparison therewith.

The retaining ring 1031, 1032, 1033, 1034 or piston ring 1011, 1012, 1013, 1014 thus has—in both cases or alternatively in only one, or else alternately—preferably one fixing element 1113 for each penetration opening 1116, ensuring that the retaining ring 1031, 1032, 1033 is connected to the piston ring 1011, 1012, 1013, 1014 by the fixing elements 1113 that penetrate in this way; that is, by virtue of the penetration openings in the sealing sleeve, the sealing sleeve 1021, 1022, 1023 is furthermore held at the profile base 1139.3 in a twist-proof manner between the piston ring and the retaining ring.

More specifically, by virtue of their circumferentially limited extent and fitting into the penetration openings 1116, the fixing pins visible in FIG. 5A, FIG. 5B and FIG. 6A, FIG. 6B, FIG. 7A, FIG. 8 and FIG. 9 as a fixing element 1113 lock the parts of the sealing arrangement 1001, 1002, 1003, 1004, 1005, 1006; that is, the piston ring 1011, 1012, 1013, 1014, 1015, 1016, the sealing sleeve 1021, 1022, 1023, 1024, 1025, 1026, and the retaining ring 1031, 1032, 1033, 1034, 1035, 1036 of the sealing arrangement 1001, 1002, 1003, 1004, 1005, 1006 are held in a twist-proof manner with respect to one another.

The additional clamping effect is explained below and results in the sealing arrangement 1001, 1002, 1003, 1004, 1005, 1006 also maintaining its sandwich structure one on top of the other. As will be explained in detail with reference to the embodiments of the sealing arrangement 1001, 1002, 1003, 1004, 1005, 1006, it is found that the fixing elements 1113 can be implemented in different ways in terms of their configuration or attachment to the retaining ring and/or piston ring.

While, in the present case, the sealing sleeve 1021, 1022, 1023, 1024, 1025, 1026 has a corresponding number of penetration openings 1116 for the number of fixing elements 1113, it is also quite possible for this to be implemented in a different way. In particular, the piston ring 1011, 1013, 1015 (FIG. 4A/FIG. 4B and FIG. 6A/FIG. 6B) can have fixing elements 1113, or the retaining ring 1032, 1034 (FIG. 5A/FIG. 5B, FIG. 7A, FIG. 9) can have fixing elements 1113; the fixing elements 1113 can also be formed separately, as shown in FIG. 8.

Correspondingly, in the present case, according to the embodiment of FIG. 4A, FIG. 4B and FIG. 6A, FIG. 6B, the retaining ring 1031, 1033 can have a receptacle—such as a groove in retaining ring 1031 or a passage as in retaining ring 1033—for a fixing element 1113. In one variant, it is correspondingly possible in the present case, according to the embodiment of FIG. 5A, FIG. 5B, FIG. 7A and FIG. 8, for the piston ring 1012, 1014, 1015 to have a receptacle—such as a groove for a fixing element 1113. Corresponding receptacles, such as a groove or a passage, are correspondingly identified by reference sign 1114.

Furthermore, in the present case, the fixing elements 1113 are arranged in a uniformly spaced manner along the annular circumference, along the circumference of the piston and the retaining ring and/or of the piston ring or the retaining ring. In the present case, the fixing elements 1113 are illustrated and embodied as clamping teeth or short webs or pegs. Nevertheless, the fixing elements can also be formed as a number of clamping screws.

In the present case, the receptacles 1114 are illustrated and configured as clamping grooves or similar receptacles for the fixing elements 1113. Nevertheless, in the case where the fixing elements are formed as a number of clamping screws, the receptacles 1114 can also be formed as screw holes—this will be described with reference to FIG. 8.

However, the configuration, illustrated here, of the fixing elements as clamping teeth has proven advantageous in comparison with the use of clamping screws for the fixing elements since locking of the clamping teeth 1113 in a clamping groove or bore or similar receptacle 1114, as explained below, can be implemented in a particularly advantageous manner.

Referring now to the first embodiment of a sealing arrangement 1001 according to FIG. 4B, it can be seen that the fixing element 1113 is formed as a clamping tooth, which engages in a receptacle 1114 in the form of a clamping groove in the retaining ring 1031. That is, that the clamping tooth as the fixing element 1113 is formed integrally on the piston ring 1011. The fixing element 1113 penetrates the penetration opening 1116 at the profile base 1139.3 of the sealing sleeve 1021 and is clamped laterally—that is, at its sides 1117.A, 1117.I—with the flanks 1114.A, 1114.I of the receptacle 1114.

Figure 5A:
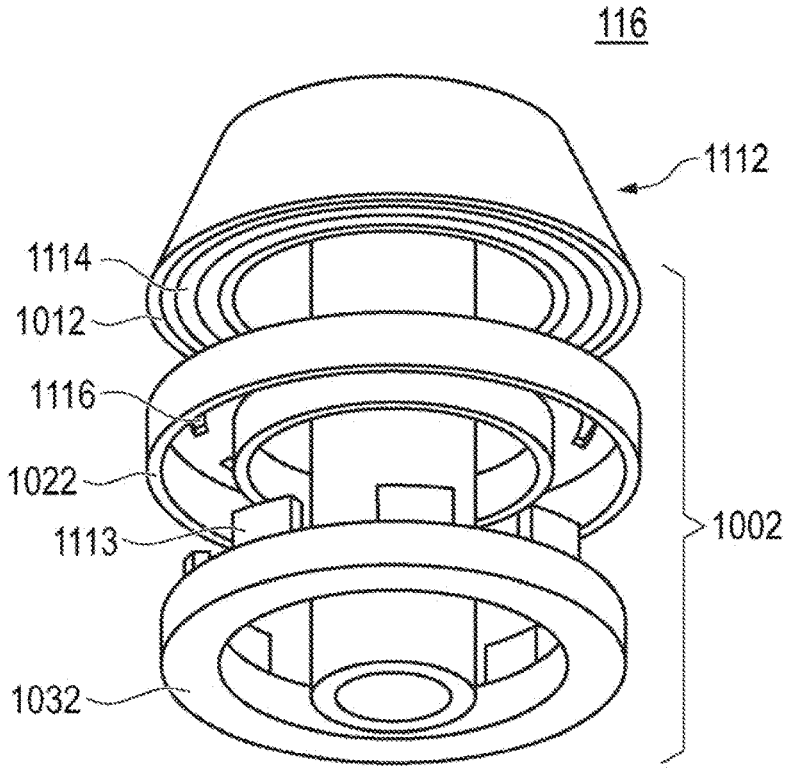
FIG. 5A shows an exploded view of a piston according to the concept of the disclosure in a second embodiment.
Figure 5B:
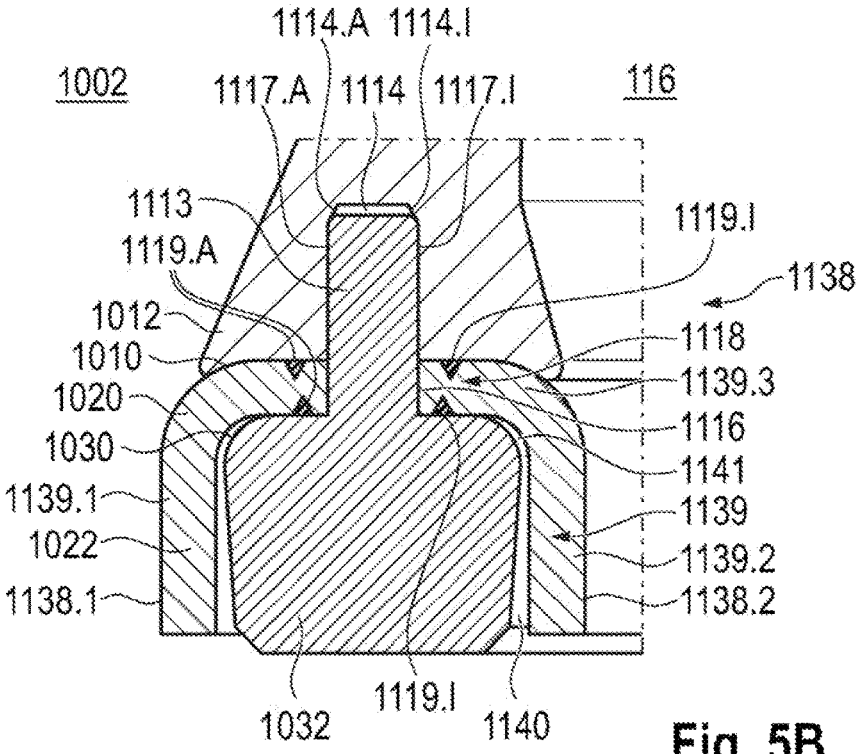
FIG. 5B shows a detail of the piston of the second embodiment according to FIG. 5A in the region of the seal.

Referring to the second embodiment of the sealing arrangement 1002 according to FIG. 5B, a fixing element 1113 is formed integrally on the retaining ring 1032 and passes through the penetration opening 1116 in the profile base 1139.3 of the sealing sleeve 1022 and thus projects into the receptacle 1114 in the piston ring 1012. Without explaining this above-explained clamping principle again in detail, it is also provided here that the fixing element 1113 configured as a clamping tooth is held in a clamping manner at its sides 1117.A, 1117.I by flanks 1114.I, 1114.A of the receptacle 1114.

Figure 6A:
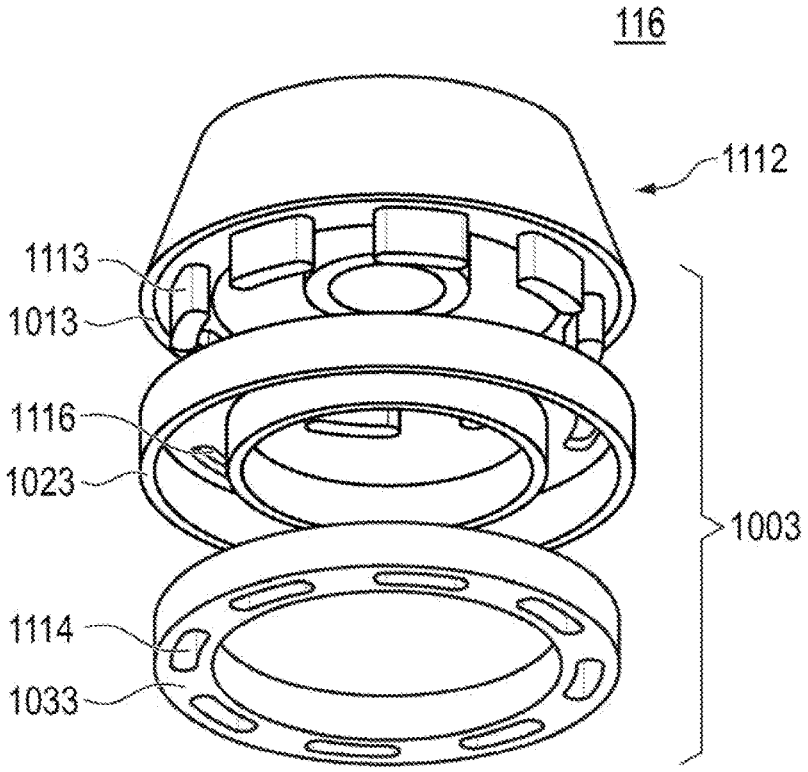
FIG. 6A shows an exploded view of a piston according to the concept of the disclosure in a third embodiment.
Figure 6B:
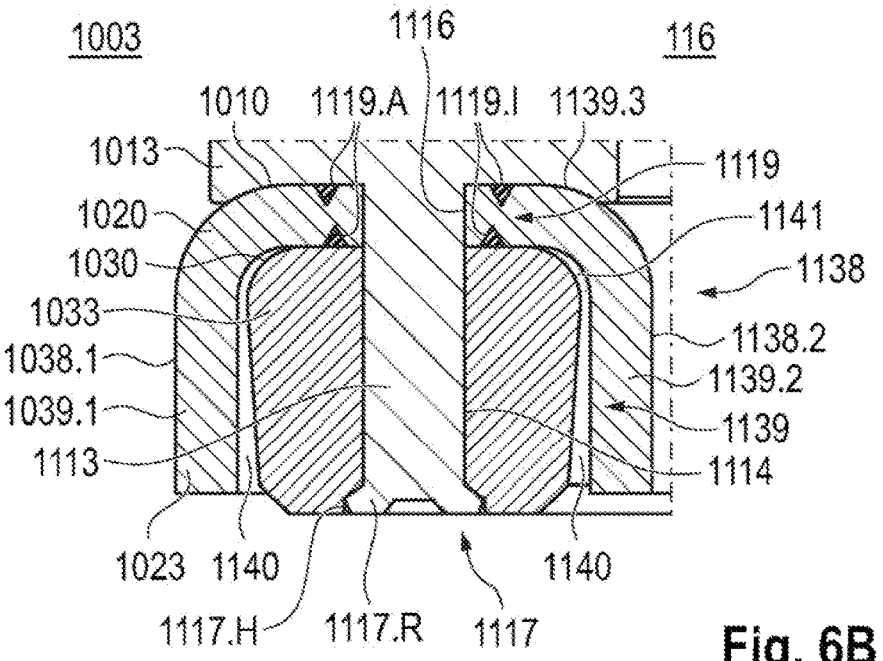
FIG. 6B shows a detail of the piston of the third embodiment according to FIG. 6A in the region of the seal.

Referring to the third embodiment of a sealing arrangement 1003, it can be seen in FIG. 6B that the fixing element 1113 is essentially configured as a rivet or clinching element, and it can therefore engage in the form of a bead 1117, via an edge 1117.R, behind an undercut 1117.H on the retaining ring 1033 on the other side of the receptacle 1114, which is formed here as a passage.

Figure 7A:
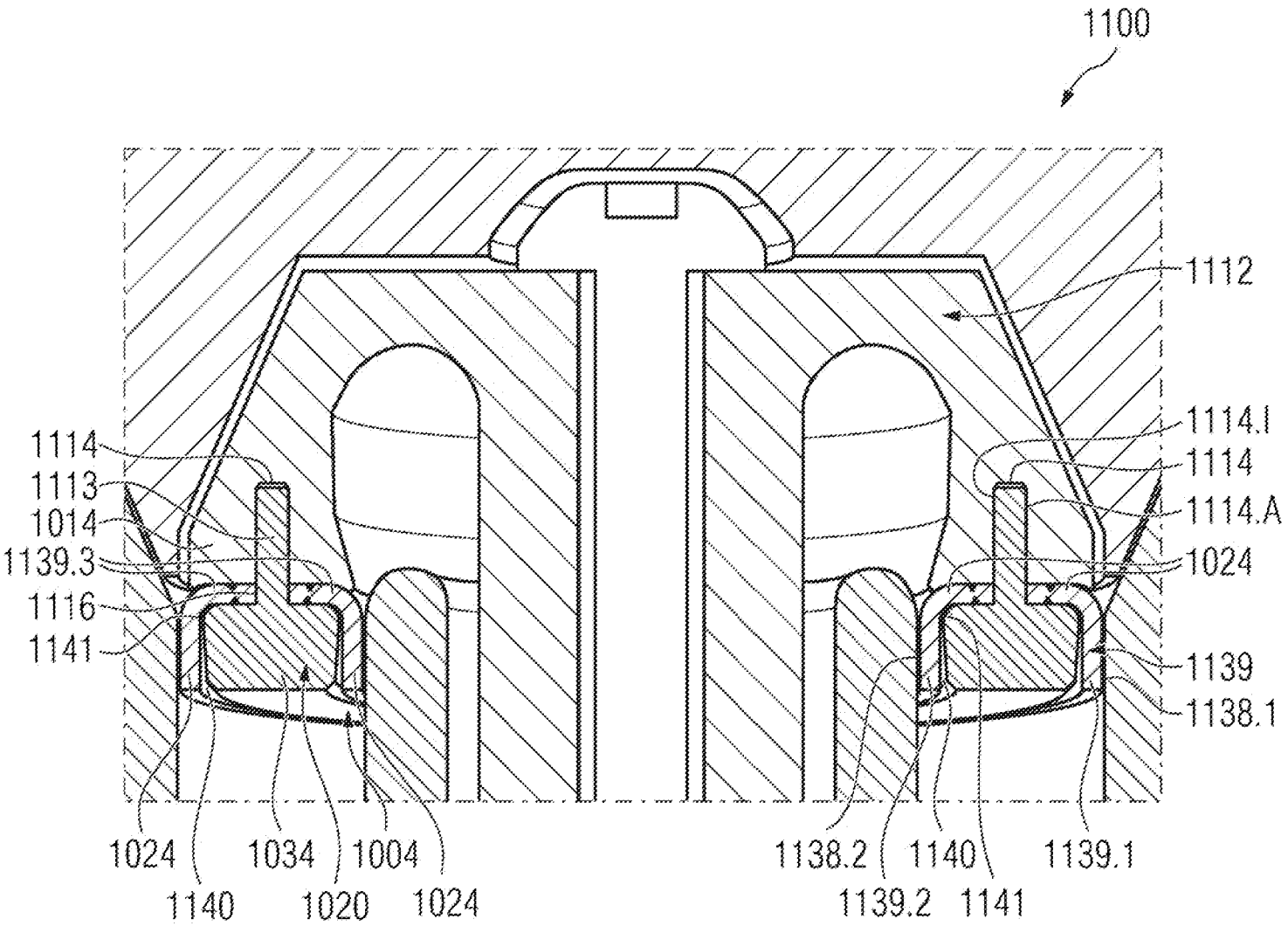
FIG. 7A shows a piston according to the concept of the disclosure in a fourth embodiment in a sectional view, illustrated in a partially shown compressor in the form of a double compressor according to the model of FIG. 2A, FIG. 2B.

FIG. 7A shows a perspective sectional view of a piston 1112 for a compressor 1100 according to the concept of the disclosure in a fourth embodiment; illustrated in a partially shown compressor 1100 in the form of a double compressor according to the model of the embodiment of FIG. 2A, FIG. 2B.

Here too, the illustrated sealing arrangement 1004 according to the concept of the disclosure has a sealing sleeve 1024, profiled in circumferential cross section, between the step-side piston ring 1014 and the compression-volume-side retaining ring 1034. In the present case, the sealing arrangement 1004 according to this fourth embodiment therefore has a step-side piston ring 1014 and, in order to form the annular seal body 1139 of a sealing sleeve 1024, and a retaining ring 1034 according to the fourth embodiment.

The annular seal body 1139 of the sealing sleeve 1024 forms the above-explained first annular lip 1139.1 on an outer side 1138.1 of the seal 1138 and the second annular lip 1139.2 on the inner side 1138.2 of the seal 1138. In the present case too, the sealing sleeve 1024 is formed as an annular seal body 1139, with a circumferential cross section shown in FIG. 7B, which, as can be seen, forms the open profile 1020.

Here too, the opening 1140 in the profile can be seen to be substantially rectangular, wherein the first and second annular lips 1139.1, 1139.2 each merge via a rounded portion 1141 into the profile base 1139.3. The profile wall of the profile 1020 provided with the profile opening 1140 is thus formed via the first and second annular lips 1139.1, 1139.2 and merges in a rounded manner into the profile base 1139.3. On the sealing sleeve 1024 too, this is the case over the entire circular ring-shaped annular circumference.

Likewise in the present case with the sealing arrangement 1004—as in the case of the above-explained embodiments of a further sealing arrangement 1001, 1002, 1003—the profiled sealing sleeve 1024—that is, like the further embodiments of the sealing sleeve 1021, 1022, 1023—is formed with a substantially U-shaped free cross section of the profile opening 1140 at the circumference; that is, forming what is to this extent an open annular groove, that is, an annular groove open to the second compression volume 106, the groove wall of which is formed via the aforementioned first and second annular lips 1139.1, 1139.2 and the base of which is formed with the aforementioned profile base 1139.3.

In the present case too, with the sealing arrangement 1004—as in the above-explained embodiments of the sealing arrangement 1001, 1002, 1003—the sealing sleeve 1024 is held in a pressure-tight manner at the profile base 1139.3 on the stepped side 116 of the piston, between a step-side piston ring 1014 and a compression-volume-side retaining ring 1034; this too is the case in all four embodiments of the sealing arrangement 1001, 1002, 1003, 1004, this being made clear in this respect by the same reference signs.

In the present case, a penetration opening 1116 is formed in the profile base 1139.3 for penetration by a fixing element, which, like the number of penetration openings 1116 in the profile base, is arranged circumferentially in a ring on the retaining ring and/or the piston ring. As explained above, a fixing element can in principle be configured in any suitable manner as a rounded, oval or even circumferentially extending, more or less wide stud, pin, peg or else a partial or full circumferential web that is relatively wide in comparison therewith.

The retaining ring 1034 and/or the piston ring 1014 thus have/has a fixing element 1113, preferably for each penetration opening 1116—in both cases or alternatively just one of the two, or both alternately—, with the result that the retaining ring 1034 is connected to the piston ring 1014 by the fixing elements 1113 that extend through it; that is, by virtue of the penetration openings in the sealing sleeve, the sealing sleeve 1024 is furthermore held at the profile base 1139.3 in a twist-proof manner between the piston ring and the retaining ring.

Figure 7B:
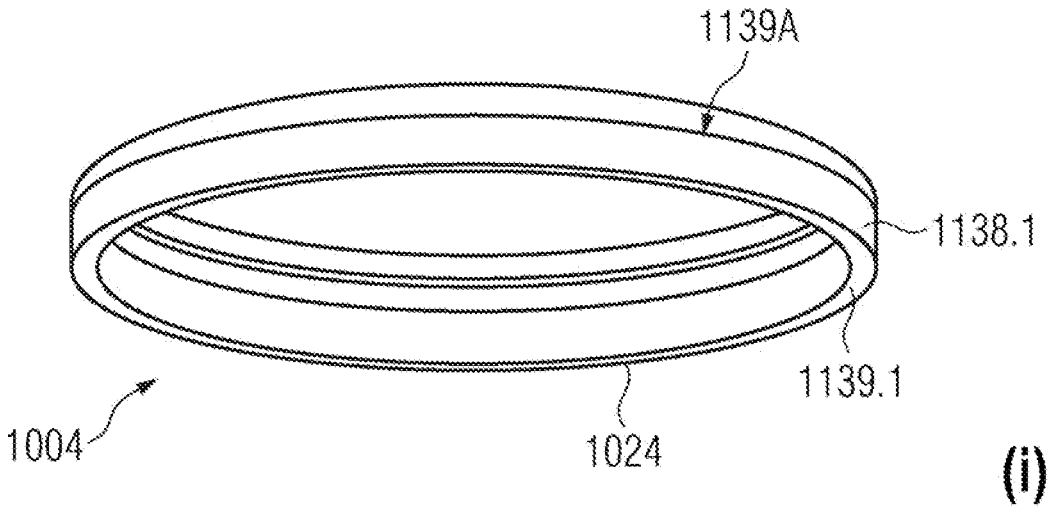
FIG. 7B shows, in view (i), a first part of the seal and a second part of the seal for the seal made of the first and second parts, as a sealing arrangement of FIG. 7A in an exploded view, as well as a retaining ring in view (ii) for insertion into a receptacle of the piston of FIG. 7C.
Figure 7B:
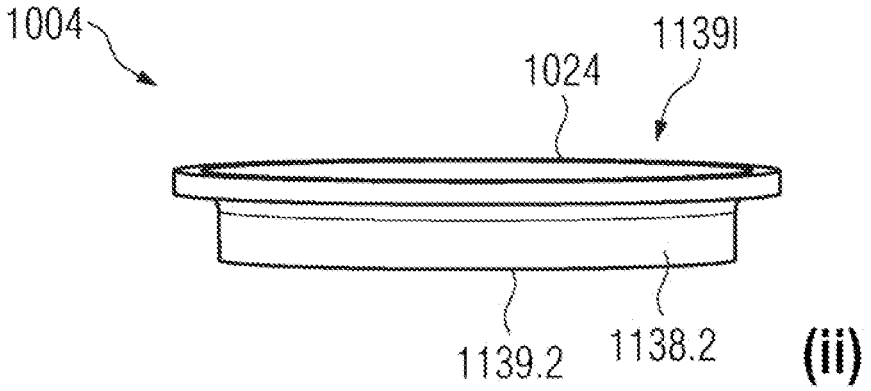

More specifically, by virtue of its circumferentially completely encircling extent and fitting into the penetration openings 1116, the fixing web that can be seen in FIG. 7A, FIG. 7B, as a fixing element 1113, locks the parts of the sealing arrangement 1004; that is, the piston ring 1014, the sealing sleeve 1024, and the retaining ring 1034 of the sealing arrangement 1004 are held in a twist-proof manner with respect to one another.

Figure 7C:
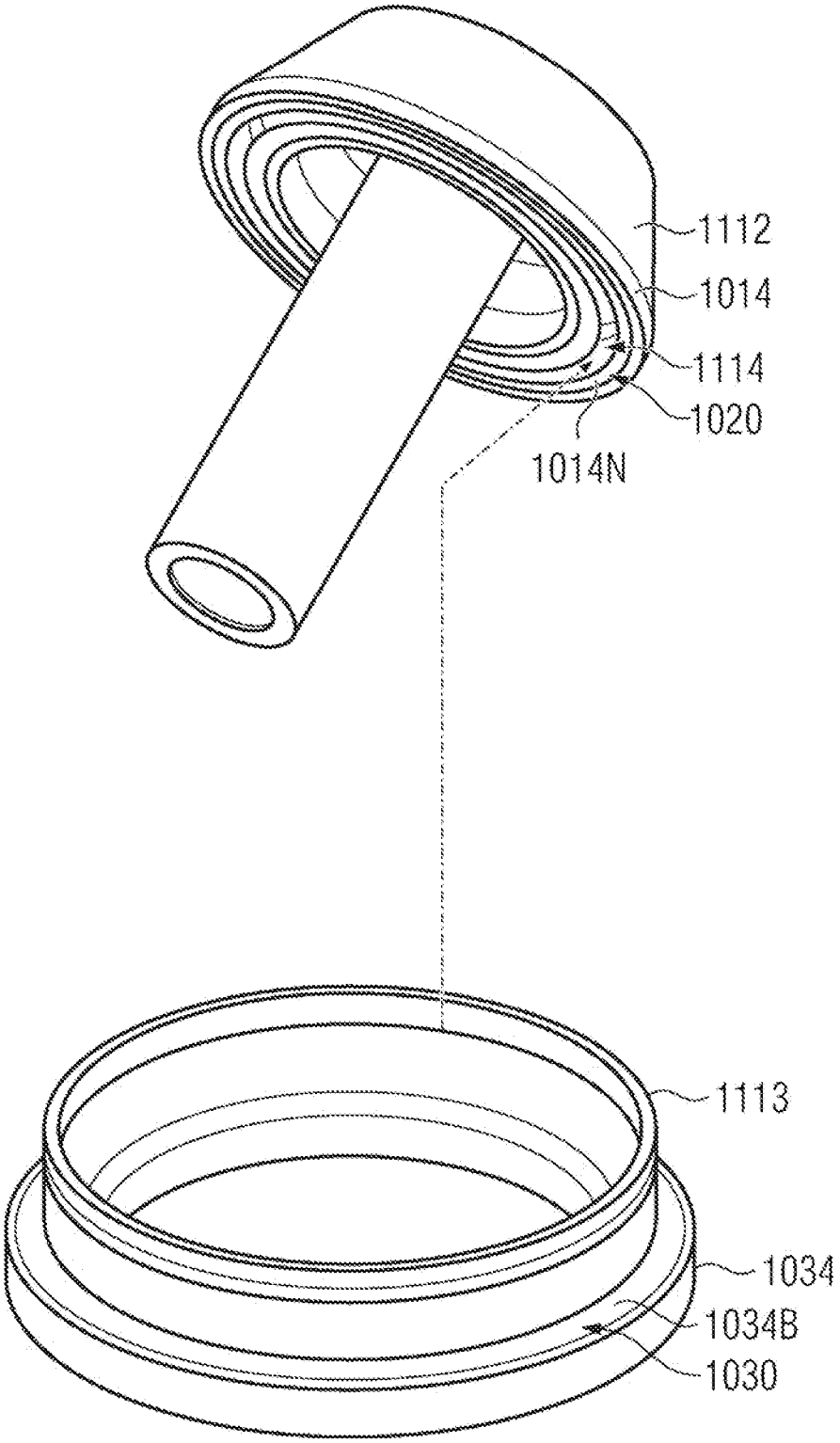
FIG. 7C shows a perspective view of the piston of FIG. 7A according to the concept of the disclosure in the fourth embodiment with the receptacle mentioned in FIG. 7B for the retaining ring in view (ii) of FIG. 7B.

The sealing arrangement 1004 according to the fourth preferred embodiment is illustrated in detail in FIG. 7B, view (i). In this regard, view (i) of FIG. 7B shows a first seal body part 1139A of the sealing arrangement 1004 and a second seal body part 1139I of the seal 1004 for the seal made of the first and second parts, as a sealing arrangement 1004 of FIG. 7A in an exploded view, as well as a retaining ring 1034 in view (ii) for insertion into a receptacle 1114 of the piston 1112 of FIG. 7C. In this regard, FIG. 7C shows a perspective view of the piston 1112 of FIG. 7A according to the concept of the disclosure in the fourth embodiment with the receptacle 1114 mentioned in FIG. 7B for the retaining ring 1034 in view (ii) of FIG. 7B.

In contrast to the above-explained embodiments of a sealing sleeve 1021, 1022, 1023, the sealing sleeve 1024 described and shown here is formed from two separate parts, as already indicated by hatching in FIG. 7A. The sealing sleeve 1024 according to the present embodiment has a first separate part 1139A lying on the outside of the annular space to form the first annular lip 1139.1 of the seal body 1139 and a second separate part lying on the inside of the annular space to form the second annular lip 1139.2 of the seal body 1139.

In this respect, the seal body parts designated here, the first part 1139A as the seal body part lying on the outside of the annular space and the second part 1139I as the seal body part lying on the inside of the annular space, are shown in an exploded view in view (i) of FIG. 7B.

The first and second seal body parts 1139A, 1139I thus do not come into contact with one another, even though together they form the sealing sleeve 1024 of the sealing arrangement 1138, with the outer side 1138.1 of the seal, designated in view (i) of FIG. 7B, and the inner side 1138.2 of the seal.

Rather, the first and second seal body parts 1139A, 1139I are in fact held at a distance—as shown in FIG. 7A—by the fixing element 1113 in the form of an annular web which runs around the entire circumference. The fixing element 1113, formed in the form of the annular web, of the sealing arrangement 1004 according to the fourth embodiment thus forms the above-designated penetration opening in the sealing arrangement 1004; in other words, the fourth embodiment of the sealing sleeve 1024 is formed in two parts, with the first and second seal body parts 1139A, 1139I, leaving a clearance for the formation of the penetration opening 1116 of the sealing sleeve 1024.

The first and second, outer and inner, seal body parts 1139A, 1139I can thus be placed separately one inside the other while maintaining the clearance—which is here established in the form of the penetration opening 1116—and thus form a concentric ring arrangement with a clearance for the penetration opening 1116 maintained therebetween.

The annular web of the fixing element 1113, as shown in view (ii) of FIG. 7B, engages in this annular clearance space thus formed, that is, the penetration opening 1116.

Specifically, the retaining ring 1034 has the annular web forming the fixing element 1113 and can engage in the receptacle 1114 of the piston ring 1014 at the moment when the annular web of the fixing element 1113 engages in the penetration opening 1116, that is, passes through the clearance left between the first and second seal body parts 1139A, 1139I. While the fixing web of the fixing element 1113 thus engages in the receptacle 1114 of the piston ring 1014 and is clamped there, the collar 1034B of the retaining ring fixes the mutually spaced seal body parts 1139A, 1139I; in this way, it fixes them relative to one another on the piston ring 1014.

The above-explained convexly arched retaining side 1030 of the retaining ring 1034 illustrated in view (ii) of FIG. 7B is configured as a collar 1034B to enable it to be pressed against the sealing side 1010 of the piston ring 1014, the sealing side being of concave configuration in the present case. This is configured in such a way that the profile base 1139.3 of the sealing sleeve 1024—that is, the profile base 1139.3 into which the first and second annular lips 1139.1, 1139.2 each merge—can be clamped between the collar 1034B and the groove 1014N of the retaining side 1030.

Nevertheless, the present fourth embodiment of a sealing sleeve 1024—that is, the sealing arrangement 1004 formed from the first and second seal body parts 1139A, 1139I, which are to this extent in fact separate, and the retaining ring 1034—offers the advantage that the fixing element 1113 (in the form of a web running around the full circumference as a ring) of the retaining ring 1034 can be introduced into the penetration opening 1116, or inserted into the receptacle 1114 of the piston ring 1014 and fixed there, in a significantly simpler manner than in the above-explained embodiments of the sealing arrangement 1001, 1002, 1003. In other words, in particular the seal body parts 1139I and 1139A on the inside of the ring and on the outside of the ring, respectively, can be inserted separately into a gap between the aforementioned collar 1034B of the retaining ring 1034 and the groove 1014N of the piston ring 1014, that is, between the sealing side 1030 of the piston ring 1014 and the retaining side 1030 of the retaining ring 1034.

In very simplified terms, it has proven advantageous to introduce each of the seal body parts 1139A, 1139I separately between the piston ring 1014 and the retaining ring 1034 in order to form the sealing arrangement 1004, rather than, conversely, introducing the retaining ring 1034 into a sealing arrangement 1004 that is already intrinsically joined together, that is, having an annular seal body 1139 that is formed in one piece and has first and second annular lips 1139.1, 1139.2.

Adjustment of the fixing element 1113 in the penetration opening 1116 of the sealing sleeve 1024 is therefore eliminated in the present case, and angularly accurate adjustment of the fixing web of the fixing element 1113 in the receptacle 1114 is also eliminated since they can therefore be locked to one another independently of the angle of rotation.

FIG. 8 shows a piston according to the concept of the disclosure in a fifth embodiment in an exploded view in view (i), with screws; these are also shown in the sectional view (ii) and in the assembled perspective view (iii) for a compressor in the form of a double compressor according to the model of FIG. 2A, FIG. 2B.

In the fifth embodiment according to FIG. 8 too, the fixing elements 1113 are in the present case arranged in a uniformly spaced manner along the annular circumference, along the circumference of the piston and the retaining ring and/or of the piston ring or the retaining ring. In the fifth embodiment shown in FIG. 8, the fixing elements 1113—previously illustrated as clamping teeth or short webs or pegs according to embodiments shown in FIG. 4A, FIG. 4B, FIG. 5A, FIG. 5B and FIG. 6A, FIG. 6B—are formed as a number of clamping screws and can be seen in this form as fixing elements 1113 in the exploded view (i).

In the case of the fifth embodiment shown in FIG. 8, the receptacles 1114—previously illustrated as clamping groups or similar receptacles for the fixing elements 1113 according to embodiments shown in FIG. 4A, FIG. 4B, FIG. 5A, FIG. 5B and FIG. 6A, FIG. 6B—are configured as screw holes; this applies to the receptacles 1114 in the piston 1112 and, in the present case, also to receptacles in the retaining ring 1035 and/or sealing sleeve 1025, as can likewise be seen in the exploded view (i).

Sealing sleeve 1025 too has a corresponding number of penetration openings 1116 for the number of fixing elements 1113; in the simplest case, these can be holes or threaded screw holes. Accordingly, in the present case, the retaining ring 1035 has a receptacle 1114 for a fixing element 1113 in the form of a screw; here, in the simplest case, this can therefore be a hole or a screw hole with a thread for the screw. In the present case, the hole or screw hole has a chamfer, which can be seen from view (i) of FIG. 8, for fitting and countersinking the screw.

In another embodiment, it is also possible in principle to conceive of some other kind of receptacle 1114, such as a groove in the retaining ring 1035 or a passage as in the retaining ring 1035. Moreover, the piston ring 1015 or the base of the piston 1112 has a receptacle 1114 for a fixing element 1113 in the form of a screw; here too, in the simplest case, this can be a hole or a screw hole with a thread for the screw. Here too, in another embodiment, a groove for a fixing element 1113 is also suitable, for instance. Corresponding receptacles, such as a groove or a passage, are identified by reference sign 1114 in FIG. 8.

As can be seen in the sectional view (ii) of FIG. 8, owing to their circumferentially limited extent and fitting into the penetration openings 1116, the fixing elements 1113 likewise lock the parts of the sealing arrangement 1005 in the manner of fixing studs—as already explained above with reference to the sealing arrangement 1001, 1002, 1003, 1004. That is, in the case of the fifth embodiment shown in FIG. 8 too—just as the piston ring 1011, 1012, 1013, the sealing sleeve and the retaining ring 1031, 1032, 1033 of the sealing arrangement 1001, 1002, 1003, 1004 are held in a twist-proof manner with respect to one another—it can be seen, particularly in the sectional view (ii), that the piston ring 1015 and the retaining ring 1035 and the sealing sleeve 1025 of the sealing arrangement 1005 are held in a twist-proof manner with respect to one another. Here, the sealing sleeve 1025 is clamped between the retaining ring 1035 and the piston ring 1015 with a suitable tightening torque of the screws as fixing elements 1113, with a corresponding clamping effect on account of the tightening torque. In the present case, the piston ring 1015 is formed in one piece with the piston 1112.

The additional clamping effect ensures that the sealing arrangement 1005 also holds together in its sandwich structure, as can be seen in view (iii) of FIG. 8; an explanation analogous to this has also been given above with reference to the embodiments of the sealing arrangement 1001, 1002, 1003, 1004.

FIG. 9 shows a piston according to the concept of the disclosure in a sixth embodiment in a disassembled perspective view for a schematically shown compressor in the form of a double compressor according to the model of FIG. 2A, FIG. 2B. In the sixth embodiment of the sealing arrangement 1006 according to FIG. 9 too, fixing elements 1113 are in the present case uniformly spaced along the circumference of the piston 1112 and the retaining ring 1036 and/or of the piston ring 1016 or the retaining ring 1036 and are arranged along the annular circumference; in a manner similar to the embodiments in FIG. 5B, a fixing element 1113 is formed as a fixing stud and here as part of the retaining ring 1036—the fixing stud thus penetrates the number of penetration openings 1116 in the sealing sleeve 1026 for the number of fixing elements 1113 in the direction of the piston ring 1016.

In the sixth embodiment shown in FIG. 9, the fixing elements 1113 (not shown here)—previously illustrated as clamping teeth or short webs or pegs according to embodiments shown in FIG. 4A, FIG. 4B, FIG. 5A, FIG. 5B and FIG. 6A, FIG. 6B—are formed as a number of integrally formed fixing studs on the retaining ring 1036. For this purpose, in the sixth embodiment, the retaining ring 1036 is cast into the sealing sleeve 1026; the cast-in mass can be used to form the retaining ring 1036 with fixing studs. The cast-in compound can flow as a plastic compound in a self-fixing manner into the penetration openings 1116 in the sealing sleeve 1026, in particular can flow further into receptacles 1114 (not shown here) in the base of the piston 1112 or in the piston ring 1016. The fixing studs as the fixing element 1113 can be held fast in the penetration opening 1116 by virtue of their circumferentially limited extent and fitting. The cast-in compound can be of adhesive configuration.

However, it is also possible for a retaining ring 1036 with fixing studs to be glued or welded as a one-piece part into the sealing sleeve 1026; for example, by ultrasonic welding. In this way, a material connection that can no longer be released is created between the retaining ring 1036 and the piston ring 1016 on the piston 1112, the connection holding fast the sealing sleeve 1026.

With reference to FIG. 10A and FIG. 10B, these illustrate a situation that can be implemented on the profile base 1139.3 of an annular seal body 1139 of a sealing sleeve, which is penetrated by a fixing element, generally independently of the above-explained embodiments. By way of example, reference is made here to a sealing arrangement 1001, 1002, 1003, 1004, 1005, 1006. However, the profile base 1139.3 of an annular seal body 1139 of a sealing sleeve can be implemented not just in the case of one of the above-explained sealing sleeves 1021, 1022, 1023, 1024, 1025 and 1026 but also in general in the case of another suitable sealing sleeve which is not explained in detail here.

In each case, the material of the profile base 1139.3 of such a sealing sleeve too is generally configured to be sufficiently soft or elastic to receive the sealing webs 1119, which are here configured as sealing blades or penetrate in some other way into the profile base 1139.3 of such a sealing sleeve too and are configured accordingly.

The sealing webs 1119 illustrated here in FIG. 10A and also FIG. 10B are thus each pressed into the profile base 1139.3 or penetrate in another way into the latter or into the volume region thereof when the profile base is being fixed between the base side of the piston ring 1011, 1012, 1013 . . . 1016 and the base side of the retaining ring 1031, 1032, 1033 . . . 1036.

Each of the sealing webs 1119 serves to improve the sealing of the sealing sleeve 1021, 1022, 1023, 1024, 1025, 1026 at its profile base 1139.3 between the sealing side 1010 of the piston ring 1011, 1012, 1013, . . . 1016 and the retaining side 1030 of the retaining ring 1031, 1032, 1033. FIG. 10A and FIG. 10B show different arrangements, which can be implemented differently or as a variation of the arrangement in the sealing arrangement 1001, 1002, 1003, 1004, 1005, 1006.

As can be seen from FIG. 10A, the sealing webs 1119 can also be set differently than can be seen in FIG. 5B, for example; that is, each of the sealing webs 1119 can be arranged at a changed radial distance from the fixing element 1113 with respect to that in FIG. 5B. Thus, specifically, FIG. 5B shows an arrangement of sealing webs 1119 in which the radially inner sealing webs 1119.I are arranged offset relative to one another, wherein the sealing web 1119.I of the retaining ring 1031 is offset radially somewhat outward, that is, closer to the penetration opening 1116. Analogously, in FIG. 5B, the radially outer sealing webs 1119.A are arranged offset with respect to one another, wherein the sealing web 1119.A of the retaining ring 1031 is offset somewhat radially inward, that is, likewise closer to the penetration opening 1116.

In the embodiment of FIG. 10A, this is different; with a slightly different designation, the sealing webs 1119.H on the retaining ring—this can therefore be different from the retaining ring 1031, 1032, 1033, 1034, 1035, 1036 according to the modification in FIG. 10A—are both offset outward further away from the penetration opening 1116, while the sealing webs 1119.K on the piston ring—this can be different from the piston ring 1011, 1012, 1013, 1014, 1015, 1016 in a modification in FIG. 10A—are both offset inward closer to the penetration opening 1116.

As can be seen from FIG. 10B, the sealing webs 1119 can also be set differently than can be seen in FIG. 5B; that is, for example, the sealing webs 1119 can be arranged on only one side but diagonally—so to speak point-symmetrically—with respect to the fixing element 1113. In a continuous line, a single sealing web 1119.K on the piston ring is a radially outer sealing web and this is offset further away from the penetration opening 1116 than the single sealing web 1119.K on the retaining ring, which is a radially inner sealing web, and this is offset closer to the penetration opening 1116 in comparison.

Conversely, the single sealing web 1119.K on the piston ring, shown in broken lines, is a radially inner sealing web and is offset further inward away from the penetration opening 1116. The single sealing web 1119.H on the retaining ring, shown in broken lines, is, on the other hand, a radially outer sealing web, and this is offset closer to the penetration opening 1116 in comparison.

In all the embodiments and variants of their arrangements, the sealing webs 1119 are formed as elements on the piston ring 1011, 1012, 1013, 1014, 1015, 1016 and/or the retaining ring 1031, 1032, 1033, 1034, 1035, 1036 by pressing into the profile base 1139.3 of a sealing sleeve and are thus configured to hold the latter in a twist-proof manner and, in particular, also to seal it. Thus, as already explained above, the sealing web 1119, 1119.K, 1119.H is generally and advantageously configured in such a way that, in order to connect the sealing sleeve by its profile base 1139.3 to the piston ring and/or the retaining ring in a pressure-tight manner, it can deform the profile base 1139.3 of the sealing sleeve; advantageously, however, it does not cut it so as to maintain its consistency.

Irrespective of the above-explained arrangement or positioning of a sealing web 1119, 1119.K, 1119.H and irrespective of the material of the piston ring 1011, 1012, 1013, 1014, 1015, 1016 and/or the retaining ring 1031, 1032, 1033, 1034, 1035, 1036, it has proven advantageous for a sealing web 1119, 1119.K, 1119.H to be configured in such a way that it presses completely or partially into the profile base 1139.3 of the sealing sleeve or can penetrate in some other way into the profile base 1139.3 of the sealing sleeve or into the volume region thereof when the profile base 1139.3 is being fixed between the base side of the piston ring 1011, 1012, 1013, 1014, 1015, 1016 and the base side of the retaining ring 1031, 1032, 1033, 1034, 1035, 1036. Thus, a sealing web is formed with an appropriately pointed penetration side, that is, advantageously a formed web edge toward the profile base of the sealing sleeve—ideally, for example, in the manner of a ridge, for example, of the aforementioned apex ridges. A hardness of the material, in particular the synthetic material, of the sealing web is advantageously greater than a hardness of the material, in particular the synthetic material, of the sealing sleeve or its profile base.

FIG. 11A shows a vehicle 400 having a compressed-air supply system 200 of FIG. 1 in schematic form, wherein the cylinder 1118 with piston 1112 of the compressor 1100 is likewise shown schematically here. Similarly to the compressor described with reference to FIG. 2A and FIG. 2B, the compressor 1100 includes:

a first compression volume 104, a second compression volume 106, an air feed connection 120 and a compressed-air outlet 124, a piston 1112 having a first end side 113, which can be subjected to pressure and which is directed toward the first compression volume 104, and a second end side 115, which can be subjected to pressure, is located opposite the first end side 113 and is directed toward the second compression volume 106, wherein the first compression volume 104 is delimited by the first end side 113 and the second compression volume 106 is delimited by the second end side 115 of the piston 1112, and the piston 1112 is connected to a drive 102 via a connecting rod 128, wherein the first compression volume 104 and the second compression volume 106 are connected to one another via a connecting line 122, wherein the connecting rod 128 is connected, in particular rigidly, and in a manner free of joints, to the piston 1112 on a piston side 128.1 and is connected to a rotating part 131 of the drive 102 in a rotatable manner on a drive side 128.2, and the first end side 113 is a solid side 114 and the second end side 115 is a stepped side 116, wherein the piston 1112 carries at least one seal 1138 on the stepped side 116, which seals the first compression volume 104 and/or the second compression volume 106, wherein the seal 1138 is formed via a profiled annular seal body 1139 having a circumferentially extending first annular lip on an outer side 1138.1 of the seal and a circumferentially extending second annular lip on an inner side 1138.2 of the seal.

According to the concept of the disclosure, the seal 1138 is part of a sealing arrangement 1001, 1002, 1003, 1004 in which it is provided that the annular seal body 1139 is formed as a sealing sleeve 1021, 1022, 1023, 1024 having a profile 1020 which is open in circumferential cross section, which has a profile base, and the profile wall of which is formed via the first annular lip 1139.1 and the second annular lip 1139.2, wherein the sealing sleeve 1021, 1022, 1023, 1024 is retained in a pressure-tight manner, by way of its profile base, on the stepped side 116, between a step-side piston ring 1011, 1012, 1013 and a compression-volume-side retaining ring 1031, 1032, 1033.

As likewise described with reference to FIG. 2A and FIG. 2B, in the context of the preferred embodiment, the connecting rod 128 is also formed in one piece with the piston 1112 and in a manner free of joints with respect to the piston 1112 in the case of the compressor 1100. In the case of the compressor 1100, in the present case the first compression volume 104 is cylindrical or cylindrical with a dome-shaped section 164, and/or the second compression volume 106 is of annular cylindrical configuration. Even if, in the embodiment described here, a connecting line 122 provides for series connection of the first compression volume 104 and the second compression volume 106—generally in the form of a series connection of two compressor stages of what is thus a multi-stage compressor—it should nevertheless be understood that the concept of the disclosure is not limited thereto. Alternatively, in another embodiment, the concept of the disclosure can also be implemented in a multi-stage compressor whose two or more compressor stages are implemented in the form of a parallel connection—generally, therefore, in the form of a parallel connection of two compressor stages of what is thus a multi-cylinder compressor.

In detail, FIG. 11B shows a vehicle 400 having a pneumatic system 500, which is implemented as part of an ECAS (Electronically Controlled Air Suspension) system for level control of the air-sprung vehicle 400 with an ECU and air springs 210 on supports 410.

The electronic lines to the ECU and the pneumatic lines to the air springs 210 and the compressed-air supply system 200 are likewise shown; these include corresponding compression springs on the wheel suspensions and the aforementioned compressed-air supply system 200, which is shown here in detail in perspective as an exploded drawing with an engine compressor and air dryer 222.

A compressed-air supply system 200 is operated in the context of the vehicle 400, including the following steps:

compressing air from a crankcase interior 160 and/or the environment U in a first compression volume 104 of the compressor 1100 to a low pressure level, further compressing the compressed air compressed to a low pressure level in the first compression volume 104 to a high pressure level in a second compression volume 106 of the compressor 1100, feeding the compressed air compressed to a high pressure level in the second compression volume 106 from the compressed-air outlet 124 via a pneumatic main line 30 to a compressed-air connection 2 of a gallery 220, in particular via an air dryer 222.

It is understood that the foregoing description is that of the preferred embodiments of the invention and that various changes and modifications may be made thereto without departing from the spirit and scope of the invention as defined in the appended claims.

LIST OF REFERENCE SIGNS (PART OF THE DESCRIPTION)

1 Total compressed-air feed
2 Compressed-air connection, first compressed-air connection
2' Second compressed-air connection
3 Vent connection
10 Compressed-air feed
30 Pneumatic main line
31 First isolating valve
32 Check valve
33 Bypass line
34 Restrictor
35 Vent line
36 Further isolating valve
37 Pneumatic line
38 Still further isolating valve
39 Further check valve
40 Further pneumatic line
41 Second isolating valve
51 Intake line
52 Filter
102 Drive, drive shaft
104 First compression volume, first compression chamber
106 Second compression volume, second compression chamber
109 Web wall inner side
110 Cylinder inner web
111 Web wall
113 First end side of the piston
114 Full side
115 Second end side of the piston
116 Stepped side
1118 Cylinder
119 Cylinder inner wall
119.1 Wall outer side of the cylinder inner wall
119.2 Wall inner side of the cylinder inner wall
120 Air feed connection
122 Connecting line
124 Compressed-air outlet
126 Charging connection
128 Connecting rod
128.1 Piston side of the connecting rod
128.2 Drive side of the connecting rod
130 Check valve
131 Rotating part of the drive
132 Eccentrically arranged shaft section, eccentric
138, 1138 Seal
138.1, 1138.1 Outer side of the seal
138.2, 1138.2 Inner side of the seal
139, **139*a*, 139*b*, 1139** Seal body
**139.1*a*, 139.1*b*, 1139.1** First annular lip
**139.2*a*, 139.2*b*, 1139.2** Second annular lip
142 Air feed valve flap
144 Connecting valve flap
146 Charging valve flap
150 Drive shaft bearing
152 Connecting rod bearing
154 Compressor housing
156 Connecting rod receiving section
158 Counterweight section
160 Crankcase interior
162 Rotary connection
164 Dome section of the cylinder
166 Piston screw
200 Compressed-air supply system
210 Air spring
211 Air bellows, bellows
212 Air spring valve
220 Gallery, gallery line
221 Spring branch line
222 Air dryer
224 Pressure medium reservoir, accumulator
230 Voltage-pressure sensor
A Piston axis
AD1 First seal
AD2 Second seal
AD3 Third seal
B Air admission direction
D Portion of the offset which is perpendicular to the stroke direction
E Venting direction
E' Further venting direction
F Spring force of the check valve
H Deflection, deflection of the piston in the stroke direction
KH Piston main diameter
KN Piston secondary diameter
M Motor
P1 First pressure, pressure in the first compression volume
P2 Second pressure, pressure in the second compression volume
PA External pressure, pressure in the crankcase interior
RA Axial direction
RR Radial direction
S1 Axis of rotation of the drive, point S1
S2 Axis of rotation of the rotary connection between connecting rod and eccentrically arranged shaft section, point
U Environment
300 Pneumatic system
400 Vehicle

410 Support
500 Pneumatic system
1001, 1002, 1003, 1004 Sealing arrangement
1010 Sealing side
1011, 1012, 1013,1014, 1015, 1016 Piston ring
1100 Compressor
1112 Piston, piston that can be subjected to pressure on both sides
1112.1 Outer cross section, outer side of the piston
1112.2 Inner cross section, inner side of the piston
1113 Number of fixing elements, clamping teeth, clamping screws
1114 Receptacle
1114.A, 1114.I Flanks
1116 Penetration opening of the sealing sleeve
1117 Bead
1117.A, 1117.I Sides
1117.R Edge
1117.H Undercut
1118 Cylinder
1119, 1119.A 1119.I Sealing web, sealing web extending radially on the inside outside and inside
1020 Open profile of the sealing sleeve
1021, 1022, 1023,1024, 1025, 1026 Sealing sleeve
1030 Retaining side
1031, 1032, 1033, 1034, 1035, 1036 Retaining ring
1100 Compressor
1138 Seal of the sealing arrangement
1138.1 Outer side of the seal
1138.2 Inner side of the seal
1139 Annular seal body
1139.1 First annular lip of the seal body
1139.2 Second annular lip of the seal body
1139A, 1139I Seal body parts
DL Compressed air
K Air compressor
KS Synthetic material
KVB Adhesive joint
R Radial direction
USVB Ultrasonically welded joint

The invention claimed is:

1. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein said sealing sleeve has said profile base between a first annular lip and a second annular lip with at least one penetration opening in said profile base, and wherein a point A in said compression-volume-side retaining ring and a point B in said step-side piston ring define a straight line segment AB that goes through said at least one penetration opening without intersecting said sealing sleeve.

2. The piston of claim 1, wherein said annular seal body is a profiled annular seal body; and, said at least one seal is formed via said profiled annular seal body which has a circumferentially extending sealing first annular lip on an outer side of said at least one seal and a circumferentially extending sealing second annular lip on an inner side of said at least one seal.

3. The piston of claim 1, wherein the sealing sleeve is formed with a profile which is open in a circumferential cross section and includes said profile base and a profile wall which is formed via a first annular lip and a second annular lip.

4. The piston of claim 3, wherein said sealing sleeve is profiled in circumferential cross section and is formed with a free cross section which is U-shaped at the circumference, forming an open annular groove having a groove wall formed via said first annular lip and said second annular lip.

5. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein the sealing sleeve is formed with a profile which is open in a circumferential cross section and includes said profile base and a profile wall which is formed via a first annular lip and a second annular lip, and wherein said compression-volume-side retaining ring rests in the open profile of said sealing sleeve and is held on said step-side piston ring.

6. The piston of claim 5, wherein said profile base is clamped between said compression-volume-side retaining ring and said step-side piston ring.

7. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein said sealing sleeve has a penetration opening or a plurality of spaced-apart penetration openings in said profile base; and, said compression-volume-side retaining ring is connected to said step-side piston ring via at least one fixing element, wherein said at least one fixing element engages through said penetration opening.

8. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve;

a plurality of fixing elements; and, said sealing sleeve having a plurality of penetration openings in said profile base which correspond to a quantity of said plurality of fixing elements, wherein each of said plurality of fixing elements engages through one of said plurality of penetration openings.

9. The piston of claim 1, wherein said sealing sleeve is formed in one piece.

10. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein said sealing sleeve is formed in multiple pieces.

11. The piston of claim 10, wherein said sealing sleeve forms said profile base between a first separate part having a first annular lip and a second separate part having a second annular lip, leaving a gap to form a penetration opening in said profile base.

12. A piston for a compressor, the piston comprising:

a piston body having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

a sealing arrangement including at least one seal and configured to be carried by the piston on said second end side, wherein said at least one seal seals said first compression volume with respect to said second compression volume;

said sealing arrangement including an annular seal body configured as a sealing sleeve; and, said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein at least one of:

said step-side piston ring has a plurality of fixing elements and said compression-volume-side retaining ring has a plurality of fixing grooves in order to obtain a connection between said step-side piston ring and said compression-volume-side retaining ring; and, said compression-volume-side retaining ring has a number of fixing elements and said step-side piston ring has a number of fixing grooves in order to obtain a connection between said step-side piston ring and said compression-volume-side retaining ring.

13. The piston of claim 1 further comprising a fixing element formed as a clamping screw screwed into a screw hole.

14. The piston of claim 1 further comprising a fixing element formed as a clamping tooth held on a clamping stop or in a clamping fit.

15. The piston of claim 1 further comprising a clamping tooth clamped in a clamping groove or being fixed via an interference fit.

16. The piston of claim 1 further comprising a clamping tooth passing through a clamping groove and being fixed via a clinch or rivet connection.

17. The piston of claim 1, wherein said step-side piston ring is arranged by securing it on said second end side or by being formed in one piece with said second end side.

18. The piston of claim 1, wherein said step-side piston is formed in one piece with said stepped side or is formed separately from said stepped side and is connected to said stepped side.

19. The piston of claim 1, wherein at least one sealing web is formed on said compression-volume-side retaining ring, wherein said at least one sealing web protrudes into the annular seal body from said compression-volume-side retaining ring.

20. The piston of claim 19, wherein said at least one sealing web is a circumferential sealing web.

21. The piston of claim 7 further comprising at least one of:

a radially inner sealing web formed on said compression-volume-side retaining ring, wherein said radially inner sealing web is offset closer to said penetration opening than a further radially outer sealing web on said step-side piston ring, said radially outer sealing web being offset further away from said penetration opening in comparison; and, a radially outer sealing web formed on said compression-volume-side retaining ring, wherein said radially outer sealing web is offset further away from said penetration opening than a further radially inner sealing web on the piston ring, said radially inner sealing web being offset comparatively closer to said penetration opening.

22. The piston of claim 1, wherein said step-side piston ring and said compression-volume-side retaining ring are each made of synthetic material, wherein said step-side piston ring and said compression-volume-side retaining ring are connected to one another via at least one of an adhesive joint and an ultrasonically welded joint.

23. The piston of claim 1, wherein, in order to form a connection between said step-side piston ring and a sealing element, said compression-volume-side retaining ring is formed by filling a U-shaped annular space of the sealing element with synthetic material.

24. A compressor comprising:

a drive;

a connecting rod;

a cylinder having a first compression volume, a second compression volume, an air feed connection, and a compressed-air outlet;

a piston for the compressor;

said piston having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

said piston having a sealing arrangement including at least one seal and configured to be carried by the piston on said second end side, wherein said at least one seal seals said first compression volume with respect to said second compression volume;

said sealing arrangement including an annular seal body configured as a sealing sleeve;

said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein said sealing sleeve has said profile base between a first annular lip and a second annular lip with at least one penetration opening in said profile base, and wherein a point A in said compression-volume-side retaining ring and a point B in said step-side piston ring define a straight line segment AB that goes through said at least one penetration opening without intersecting said sealing sleeve;

said piston being configured to be movably guided in said cylinder during operation of the compressor and being configured to be connected to said drive via said connecting rod; and, said connecting rod being configured to be connected to said piston on a piston side and configured to be connected to a rotating part of said drive in a rotatable manner on a drive side.

25. The compressor of claim 24, wherein the compressor is an air compressor for a compressed air feed of a compressed-air supply system.

26. The compressor of claim 24, wherein said connecting rod is formed in one piece with said piston and is free of joints with respect to said piston.

27. The compressor of claim 24, wherein said connecting line is connected to give a series connection of two compressor stages or else alternatively is connected in parallel.

28. The compressor of claim 24, wherein at least one of:

said first compression volume is delimited by said first end side of said piston and said second compression volume is delimited by said second end side of said piston;

said first compression volume is of cylindrical configuration or of cylindrical configuration with a dome-shaped section; and, said second compression volume is of annular cylindrical configuration.

29. A compressed-air supply system comprising:

a compressor having a drive, a connecting rod, and a cylinder;

said cylinder having a first compression volume, a second compression volume, an air feed connection, and a compressed-air outlet;

a piston for the compressor;

said piston having a first end side configured to be subjected to pressure and to be directed, during operation, toward a first compression volume of the compressor;

said piston body having a second end side configured to be subjected to pressure;

said second end side being disposed opposite said first end side and configured to be directed, during operation, toward a second compression volume of the compressor;

said first compression volume and said second compression volume being interconnected via a connecting line configured to be subjected to pressure;

said first end side being configured as a full-surface-area full side and said second end side being configured as an annular, stepped side;

said piston having a sealing arrangement including at least one seal and configured to be carried by the piston on said second end side, wherein said at least one seal seals said first compression volume with respect to said second compression volume;

said sealing arrangement including an annular seal body configured as a sealing sleeve;

said annular seal body being retained in a pressure-tight manner, by way of a profile base, on said stepped side between (A) a step-side piston ring arranged on said second end side and (B) a compression-volume-side retaining ring arranged on the second compression volume side of the sealing sleeve, wherein said sealing sleeve has said profile base between a first annular lip and a second annular lip with at least one penetration opening in said profile base, and wherein a point A in said compression-volume-side retaining ring and a point B in said step-side piston ring define a straight line segment AB that goes through said at least one penetration opening without intersecting said sealing sleeve;

said piston being configured to be movably guided in said cylinder during operation of the compressor and being configured to be connected to said drive via said connecting rod;

said connecting rod being configured to be connected to said piston on a piston side and configured to be connected to a rotating part of said drive in a rotatable manner on a drive side;

an air feed;

said compressor being connected to said air feed via an air feed connection;

a pneumatic main line pneumatically connected to said compressor via a compressed-air outlet and having an air dryer, leading to a compressed-air connection of a gallery; and, a pressure medium reservoir pneumatically connected to said compressor via a charging connection.

30. The compressed-air supply system of claim 29, wherein the system is for operating a pneumatic system.

31. A vehicle comprising the compressed-air supply system of claim 29.

32. A method for operating the compressed-air supply system of claim 29, the method comprising:

compressing air from at least one of a crankcase interior and an environment in the first compression volume of the compressor to a low pressure level;

further compressing the compressed air compressed to a low pressure level in the first compression volume to a high pressure level in the second compression volume of the compressor; and, feeding the compressed air compressed to a high pressure level in the second compression volume from the compressed-air outlet via the pneumatic main line to the compressed-air connection of the gallery.

33. The piston of claim 1 further comprising at least one of:

a radially inner sealing web formed on said compression-volume-side retaining ring, wherein said radially inner sealing web is offset closer to a penetration opening of said sealing sleeve than a further radially outer sealing web on said step-side piston ring, said radially outer sealing web being offset further away from said penetration opening in comparison; and, a radially outer sealing web formed on said compression-volume-side retaining ring, wherein said radially outer sealing web is offset further away from said penetration opening than a further radially inner sealing web on the piston ring, said radially inner sealing web being offset comparatively closer to said penetration opening.

34. The piston of claim 7, wherein said at least one fixing element is formed integrally on said compression-volume-side retaining ring.

* * * * *